US007448969B2

(12) United States Patent
Weber et al.

(10) Patent No.: US 7,448,969 B2
(45) Date of Patent: Nov. 11, 2008

(54) PROJECTED IMPLEMENT ENTERTAINMENT DEVICE

(75) Inventors: Gary E. Weber, Buffalo, NY (US); Erica M. Nissen, Buffalo, NY (US); Jeffrey A. Brown, Hamburg, NY (US)

(73) Assignee: Mattel, Inc., El Segundo, CA (US)

( * ) Notice: Subject to any disclaimer, the term of this patent is extended or adjusted under 35 U.S.C. 154(b) by 303 days.

(21) Appl. No.: 11/244,282

(22) Filed: Oct. 6, 2005

(65) Prior Publication Data

US 2007/0082764 A1 Apr. 12, 2007

(51) Int. Cl.
*A63B 63/00* (2006.01)
*A63B 63/08* (2006.01)

(52) U.S. Cl. ..... 473/476; 273/396

(58) Field of Classification Search ..... 473/476, 473/479, 480, 481; 273/395, 394, 396
See application file for complete search history.

(56) References Cited

U.S. PATENT DOCUMENTS

| | | | | |
|---|---|---|---|---|
| D110,225 | S | 6/1938 | Schutt | |
| 2,194,779 | A | 3/1940 | Albach | |
| 2,278,616 | A | 4/1942 | Kettering | |
| 2,413,952 | A | 1/1947 | Chervenka | |
| 2,658,495 | A * | 11/1953 | Elliot, Sr. | 124/7 |
| 3,350,097 | A | 10/1967 | Chevrette et al. | |
| 3,561,762 | A | 2/1971 | Russell | |

(Continued)

FOREIGN PATENT DOCUMENTS

EP 1405656 A1 4/2004

(Continued)

OTHER PUBLICATIONS

Brillian Basics™ Musical Rocking Pony, Product #: B9764, Fisher-Price, http://www.fisher-price.com/us/infanttoys/products.asp?id=28578, Mar. 24, 2005.

(Continued)

*Primary Examiner*—Gene Kim
*Assistant Examiner*—M Chambers
(74) *Attorney, Agent, or Firm*—Edell, Shapiro & Finnan, LLC

(57) ABSTRACT

A reconfigurable target/projectile activity entertainment device is disclosed, wherein the device includes a projectile, a target having a target area and a reversible base connectable to the target. The target is in the form of a hoop or ring and is disposed above the reversible base. The hoop has an opening therein that forms the target area. The hoop contains a sensor that detects a projectile passing through the target area and communicates with a sensory generator to generate sensory-stimulating output (i.e., lights and sounds). Projectiles directed through the target area drop to the reversible base below the target area. The reversible base has a first side and a second side. The first side is concave for collecting a projectile that drops thereon. The second side is opposite the first side and has a convex side that deflects projectiles dropping thereon to deflect the projectile away from the device. The reversible base can be reconfigured between a first mode wherein the concave side faces the target area and a second mode that wherein the convex side faces the target.

20 Claims, 20 Drawing Sheets

U.S. PATENT DOCUMENTS

| | | | | | |
|---|---|---|---|---|---|
| 3,596,911 | A | | 8/1971 | Kessler | |
| 3,599,978 | A | | 8/1971 | Sondergaard | |
| 3,913,916 | A | * | 10/1975 | Martin, Jr. | 473/479 |
| 3,967,819 | A | * | 7/1976 | Lewis | 473/485 |
| 4,013,292 | A | | 3/1977 | Cohen et al. | |
| 4,084,273 | A | | 4/1978 | Haynes | |
| 4,253,669 | A | | 3/1981 | Ferris et al. | |
| 4,421,318 | A | | 12/1983 | Sverdlik et al. | |
| D277,884 | S | | 3/1985 | Offutt | |
| 4,512,578 | A | | 4/1985 | Dalton | |
| 4,595,199 | A | | 6/1986 | Offutt | |
| 4,611,812 | A | | 9/1986 | Morrison | |
| 4,858,920 | A | | 8/1989 | Best | |
| 4,984,787 | A | | 1/1991 | Nesbit et al. | |
| 5,064,195 | A | | 11/1991 | McMahan et al. | |
| 5,277,431 | A | | 1/1994 | O'Grady | |
| 5,403,000 | A | | 4/1995 | Woosley | |
| 5,524,881 | A | | 6/1996 | Edward | |
| 5,788,242 | A | * | 8/1998 | Rudell et al. | 273/317.3 |
| 6,402,153 | B1 | | 6/2002 | Stewart | |
| 6,416,381 | B1 | | 7/2002 | Walter et al. | |
| 6,418,179 | B1 | | 7/2002 | Shieh | |
| 6,582,329 | B1 | * | 6/2003 | Cabrera | 473/480 |
| 6,692,385 | B2 | | 2/2004 | Walker, Jr. et al. | |
| 6,899,647 | B2 | | 5/2005 | Chia | |
| 2004/0102260 | A1 | | 5/2004 | Chia | |
| 2004/0242347 | A1 | | 12/2004 | Langhorn | |

FOREIGN PATENT DOCUMENTS

| | | |
|---|---|---|
| FR | 2643824 | 9/1990 |

OTHER PUBLICATIONS

Shoot n' Score Basketball, Hasbro, http://www.amazon.com/exec/obidos/1g/detail/-/B00008X35J/qid=11..., Jan. 27, 2005.

Grow to Pro® Basketball, Model No. 72408, Replacement Instructions, Fisher-Price, Inc., ©2001.

Baby Playzone™ Swirlin' Saucer™, Product #: B9756, Instructions, Mattel, Inc., http://service.mattel.com/us/productPopup.asp?id=B9756, Jan. 27, 2005.

Baby Playzone™ Basketball, Product #: 74069, Instructions, Mattel, Inc., http://service.mattel.com/us/productPopup.asp?id=74069, Jan. 27, 2005.

Baby Playzone™ Stand-Up Ball Blast™, Product #: 73397, Mattel, Inc., http://service.mattel.com/us/productPopup,asp?id=73397, Jan. 27, 2005.

* cited by examiner

PROJECTED IMPLEMENT ENTERTAINMENT DEVICE

FIELD OF THE INVENTION

The present invention relates to an entertainment device and, more particularly, to a convertible, projected implement/target activity device, where the device includes a projectable implement and a target area and where, in one mode, the projected implement reaching the target area is thereafter contained by the entertainment device and, in a second mode, the projected implement reaching the target area is thereafter directed away from the entertainment device to encourage more active children to pursue and retrieve the projected implement.

BACKGROUND

Young children enjoy placing or throwing projectiles in defined areas such as holes, hoops or other types of open target areas. Children develop and become more mobile as they explore crawling, walking and other motor skills. At each stage of development, a child will be more agile and capable than in earlier stages of development. Parents want to encourage exploration at each developmental stage in order to assist in passage to the next developmental stage. To this end, reconfigurable entertainment devices offer parents an opportunity to encourage exploration at various developmental levels. Reconfigurable entertainment devices can provide skill level appropriate stimulation at one developmental stage and can then be reconfigured to provide appropriate stimulation at a more advanced skill level/developmental stage.

In the present case, a reconfigurable childrens' projected implement/target activity device is disclosed. The device can be reconfigured into multiple configurations to stimulate children of different distinct skill and developmental levels. The device includes a graspable projectable implement, a target area and a projected implement movement controller. A child directs the implement through the target area after which the projected implement movement controller controls the movement of the implement. The projected implement can be a ball or any object that a child can grasp easily. The target area can be the open area of a ring, hoop, or other opening, through which the projected implement passes. The target area may be suspended above the projected implement movement controller. The projected implement movement controller may also function as a reversible base for the activity device.

The projected implement movement controller of the present invention includes a first side and a second side. The first side of the projected implement movement controller has a concave shape and the second side has a convex shape. In a first configuration of the activity device of the present invention, the first side of the projected implement movement controller faces the target area so that a projected implement, passing through the target area, comes in contact with the projected implement movement controller. Because the first side of the projected implement movement controller is concave, when the projected implement passes through the target area, the projected implement is contained in the concave, bowl-shaped, side of the movement controller within proximity of the child. Alternatively, when the reversible projected implement movement controller is reconfigured to expose the movement controller's, second, convex side and the projected implement passes through the target area, the projected implement deflects off of the movement controller's dome-shaped, convex, surface and moves away from the activity device.

The activity device according to the present invention therefore facilitates two modes of activity for children at different developmental levels. In the first mode where the concave, bowl-shaped, surface of the projected implement movement controller faces the target area, a younger, less mobile, child can place the implements through the target area and the movement controller will corral and contain the implements in close proximity to the child. This first mode also provides a convex surface pointing away from the target area and toward the supporting surface. In the first mode, the convex surface of the projected implement movement controller contacts the supporting surface to allow the activity device to rock back and forth as the child plays. In the second activity mode where the convex, dome-shaped surface of the projected implement controller faces the target area, the projected implements are deflected away from the activity device and must be retrieved as the child plays. This second activity mode therefore encourages children to be more active and further improves their motor skills and hand-eye coordination.

The activity device of the present invention also provides sensory-stimulating rewards for a child successfully reaching the target area with a projected implement. An optical sensor may be utilized in the target area to sense the presence of the projected implement in the target area. Thus, the presence of the projected implement in the target area may trigger sensory-stimulating output from the activity device. The sensory-stimulating output may include lights, sound effects, speech, and/or music. Thus, a child that successfully reaches the target area with the projected implement is therefore rewarded with sensory-stimulating output to encourage continued play. Additionally, the activity device of the present invention could also incorporate a motion sensor to generate sensory-stimulating output at the slightest touch to further encourage continued play.

SUMMARY

Generally, the present invention device discloses a children's activity device comprising a projectable implement and a target area at which the implement is to be directed. The activity device includes a sensor that senses when the target area has been successfully reached by the projected implement and a sensory-stimulating output generating device that receives a signal from the sensor. When the sensory-stimulating output generating device receives the success signal from the sensor, it generates sensory-stimulating to encourage continued play. Specifically, the present invention discloses an activity device having a target area for receiving a plurality balls and an electronics unit including a sensor that detects the presence of a ball passing through the target area and a electronics controller that instructs the generation of sensory-stimulating output upon such detection.

The present invention further contains a reconfigurable projected implement movement controller that directs and controls the movement of the projected implement after the target are has been successfully reached. The projected implement movement controller is reconfigurable in that one side of the projected implement movement controller is convex to direct a projected implement away from the activity device while the opposite side of the movement controller is concave to corral and contain the projected implement within the proximity of the activity device. The projected implement movement controller is connected to the target are such that, relative to the target area, the projected implement movement controller is reversible between the concave and convex sides. When the projected implement movement controller is oriented in the convex arrangement, balls passing through the target area, fall on the movement controller and are directed away from the activity device. Conversely, when the projected implement movement controller is reversed so that the concave side is directed upward, the balls passing through the target area are contained in the movement controller in close proximity to the activity device.

BRIEF DESCRIPTION OF THE DRAWINGS

Like reference numerals have been used to identify like elements throughout this disclosure.

DETAILED DESCRIPTION

In accordance with the present invention, an activity entertainment device 100 is disclosed. The activity device 100 is a reconfigurable to allow for two different modes of activity. In a containment mode, the activity device 100 contains or corrals the projected implements that have passed through the target area to accommodate less mobile/younger children. Alternatively, in a second, deflection mode, projected implements that pass through the target area are deflected away from the activity device 100, requiring the child to retrieve the projected implements and thereby encouraging retrieval activity. In addition, in the containment mode, the portion of the base of the activity device 100 that is in contact with the supporting surface is convex to allow for the rocking of the activity device 100. In the deflection mode, the portion of the base of the activity device 100 that is in contact with the supporting surface is concave and thus, a stable, non-rocking, characteristic is achieved.

Figure 1:
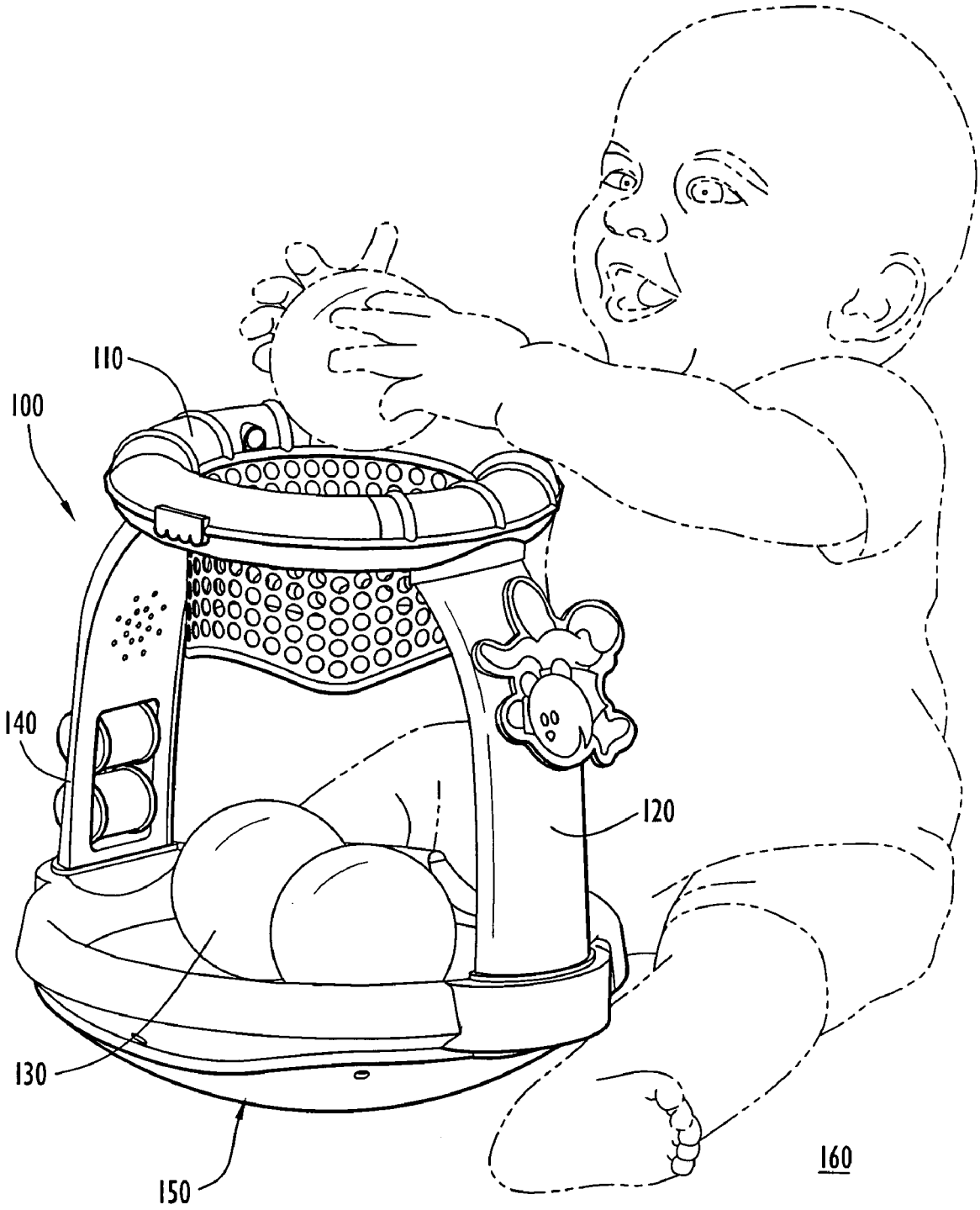
FIG. 1 illustrates a perspective view of a child playing with the activity device of the present invention, with the activity device shown in its containment mode.

FIG. 1 illustrates a perspective view of a child playing with the activity device 100 of the present invention, with the activity device 100 shown in its containment mode. As shown, the activity device 100 is a drop/toss toy with a hoop-type target portion 110 that senses a projectile 130 passing through the target portion 110 and generates music to reward the child when a projectile 130 such as a ball is tossed through the target portion 110. The activity device 100 generally comprises a target portion 110 formed as a hoop or ring, a bowl shaped reversible base 150 for directing the projectile after passing through the target portion 110, support arms 120 and 140 for supporting the target portion 110 above the reversible base 150 and projectiles 130. In the containment mode, the reversible base 150 corrals the projectiles 130 that have passed through the target portion 110. As illustrated, in the containment mode, the convex portion of the reversible base 150 is in contact with the supporting surface 160 to provide a rocking motion for the activity device 100.

Figure 2:
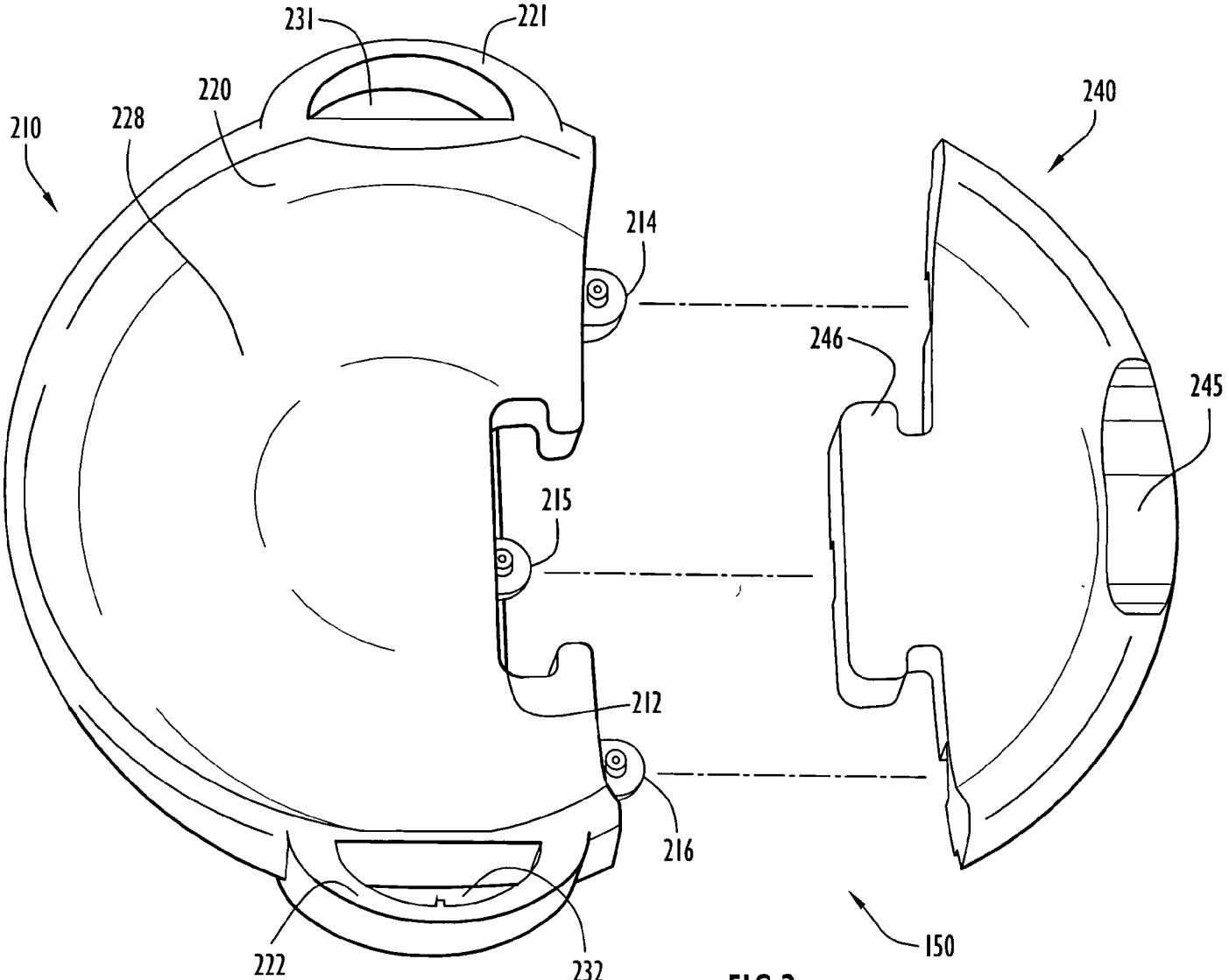
FIG. 2 illustrates an enlarged top perspective view of the concave side of the reversible projected implement movement controller/base of the activity device of FIG. 1, showing the base split into its two component parts.

FIG. 2 illustrates an enlarged top perspective view of the concave side of the reversible projected implement movement controller/base of the activity device of FIG. 1, showing the base split into its two component parts. In order to reduce the size of the retail packaging (not shown) for the activity device 100 of the present invention, the reversible base 150 is constructed from two separate interlocking portions (210 and 240).

Portion 210 includes of a female receptacle 212. Female receptacle 212 is designed to receive key 246 on portion 240. Portion 210 also includes a plurality of fastener tabs 214, 215, 216 with apertures therein. The fastener tabs 214, 215, 216 extend from the side of portion 210. Portion 240 contains a series of fastener-receiving recesses 341, 342, 343 (best seen in FIG. 3). Each fastener-receiving recess 341, 342, 343 is adapted to mate with a corresponding fastener tab 214, 215, 216 on portion 210 and receive a fastener.

The female receptacle 212, key 246, fastener tabs 214, 215, 216, and fastener-receiving recesses 341, 342, 343 provide a simple, stable way to secure the portions 210 and 240 of the the reversible base 150 together after removal from the retail packaging (not shown). To secure the portions 210 and 240 together, portion 240 is held above the portion 210 so that fastener tab 214 is aligned with fastener-receiving recess 341, fastener tab 215 is aligned with fastener-receiving recess 342, and fastener tab 216 is aligned with fastener-receiving recess 343. Portion 240 is then lowered so that the corresponding fastener tabs fit snuggly within the corresponding fastener-receiving recesses. The female receptacle 212 and the key 246 will obviously also align and fit snuggly together. Portion 210 can then be secured to the portion 240 by directing fasteners through a apertures in the fastener tabs 214, 215, 216, into the corresponding fastener-receiving recesses 341, 342, 343. The heads of the fasteners may be countersunk into the fastener tabs 214, 215, 216 so that they do not protrude above the surface on the convex side 330 of the reversible base 150.

Figure 3:
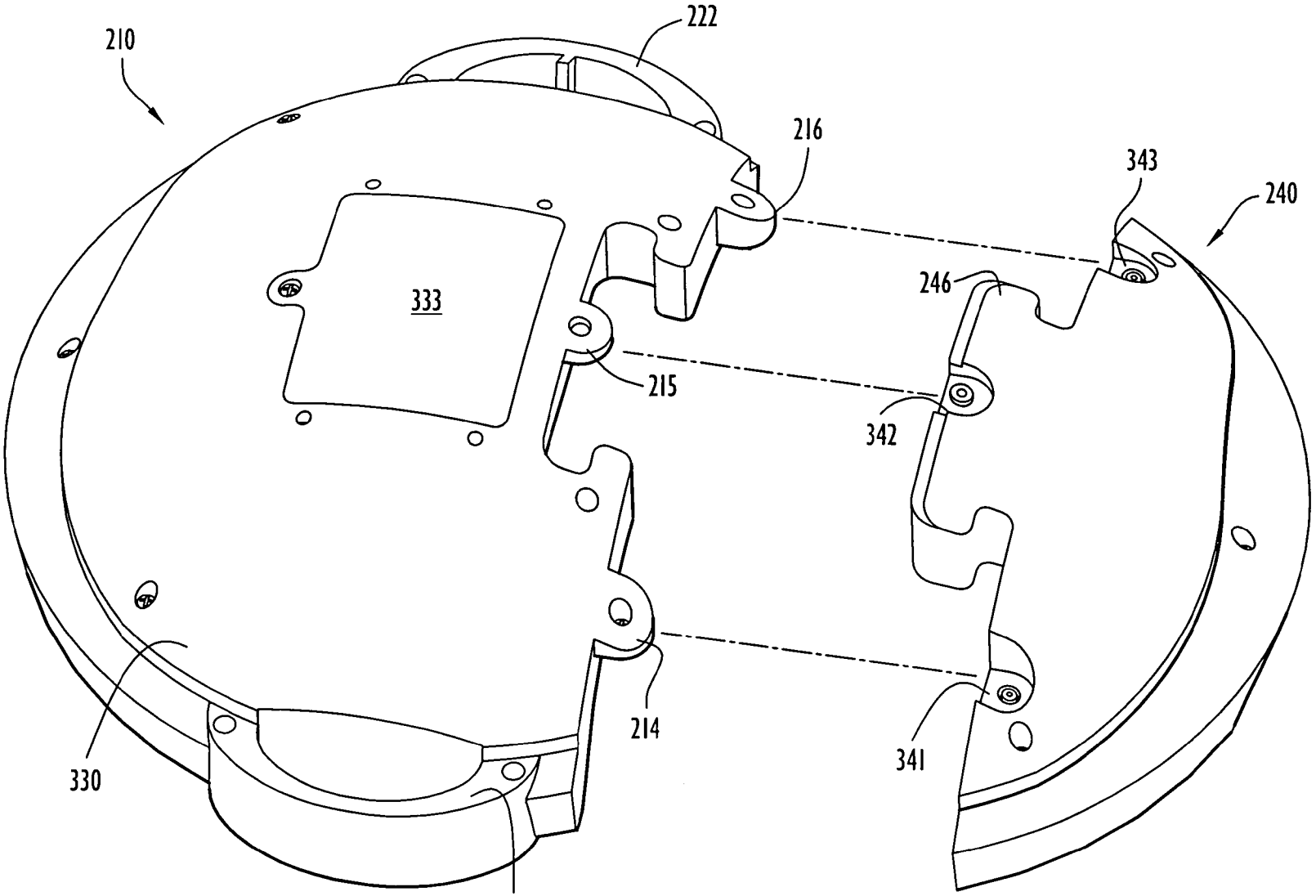
FIG. 3 illustrates an enlarged top perspective view of the convex side of the reversible projected implement movement controller/base of the activity device of FIG. 2.

As shown in FIGS. 2-5, the reversible base 150 includes looped members 221 and 222 that form support arm reception slots 231 and 232 for receiving portions of support arms 120 and 140. As shown in FIG. 2, the reversible base 150 has a swirl pattern 228 molded into the concave surface of the containment side 220 of the reversible base 150. Additionally, portion 240 of the reversible base 150 includes an arcuate opening 245 for easy removal of the projectiles 130 from the reversible base 150 during play. FIG. 3 shows a battery compartment door 333 on the convex side 330 of the reversible base 150. The battery compartment door 333 covers a compartment area where the batteries that power the activity device 100 located. A countersunk fastener secures the door 333 in a closed position so that neither the door 333 or the fastener protrude above the convex side 330 of the reversible base 150.

Figure 4:
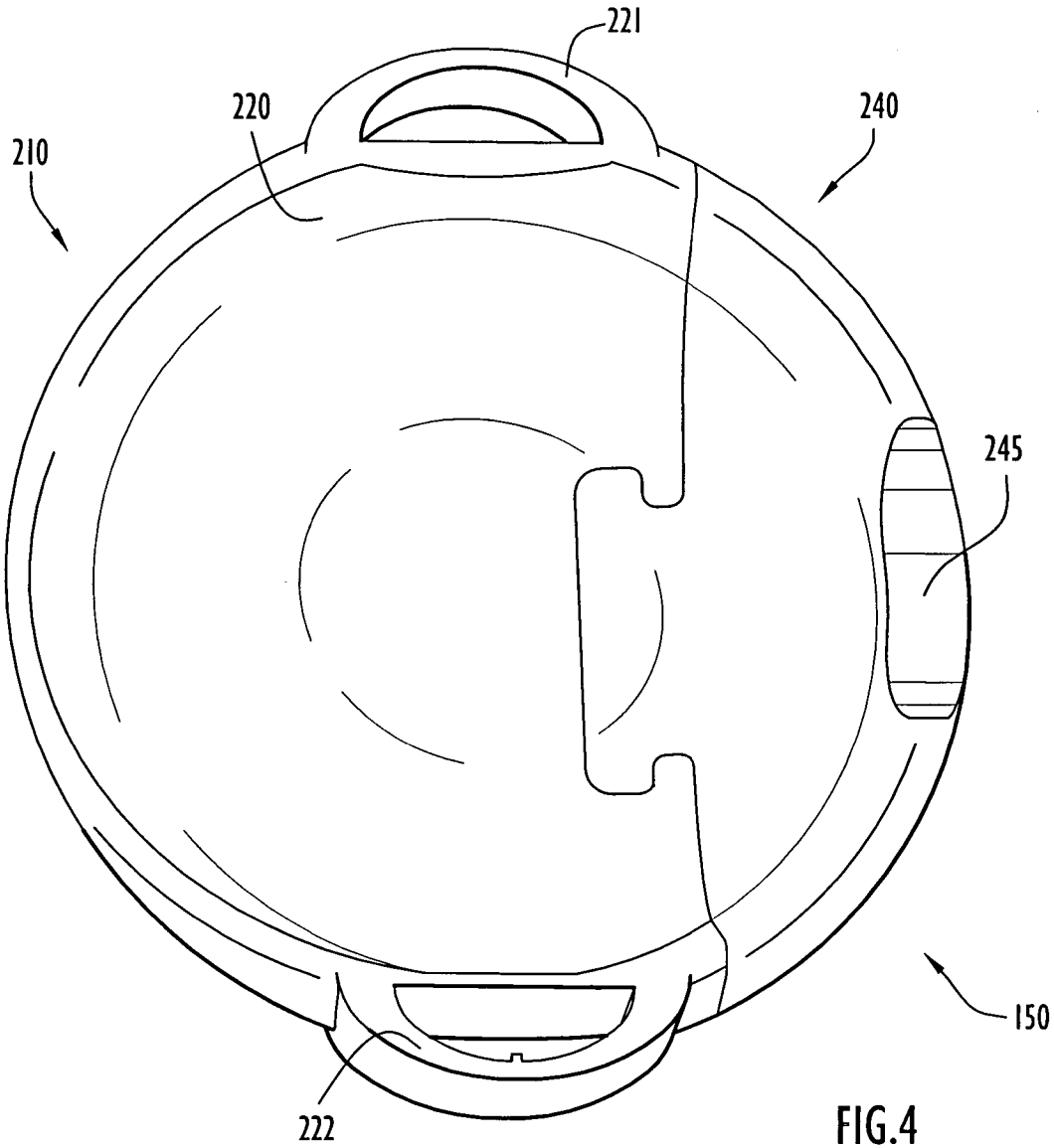
FIG. 4 illustrates an enlarged top perspective view of the concave side of the reversible projected implement movement controller/base of the activity device of FIG. 1 in its assembled form.
Figure 5:
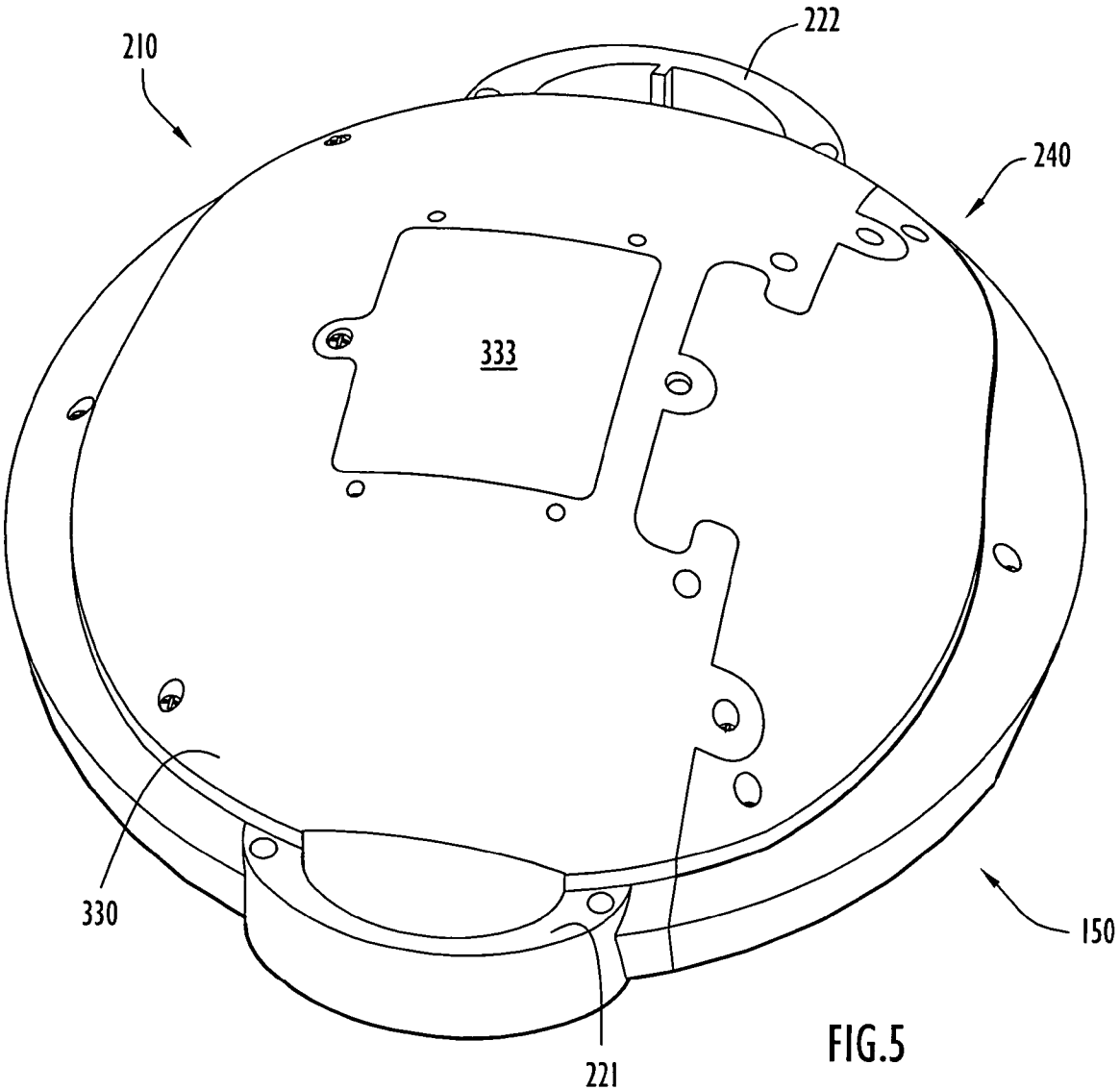
FIG. 5 illustrates an enlarged top perspective view of the convex side of the reversible projected implement movement controller/base of the activity device of FIG. 1 in its assembled form.
Figure 6:
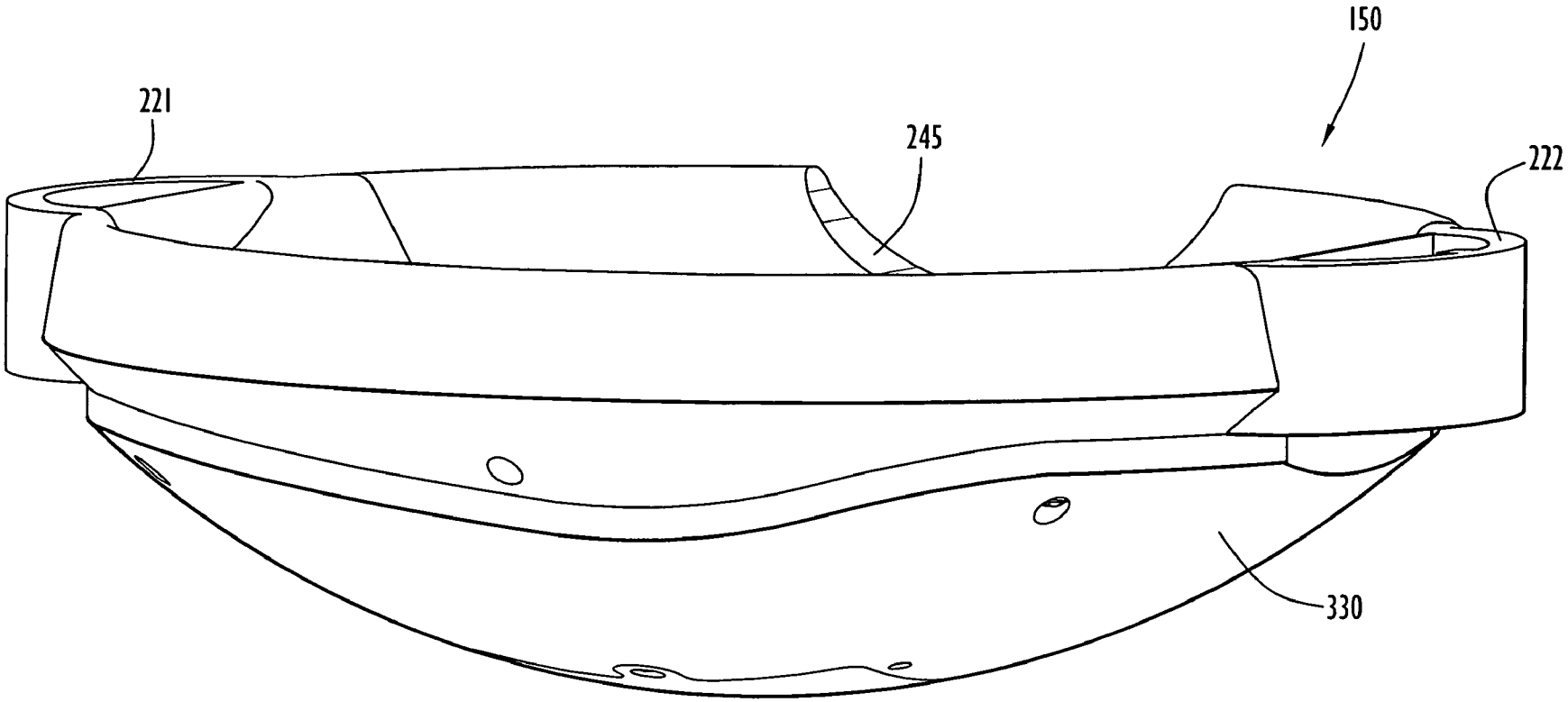
FIG. 6 illustrates an enlarged side perspective view of the reversible projected implement movement controller/base of the activity device of FIG. 1.

FIGS. 4-6 show the reversible base 150 in its assembled form. FIG. 4 illustrates an enlarged top perspective view of the concave side 220 of the reversible projected implement movement controller/base 150 of the activity device 100 of FIG. 1 in its assembled form. FIG. 5 illustrates an enlarged top perspective view of the convex side 330 of the reversible projected implement movement controller/base 150 of the activity device 100 of FIG. 1 in its assembled form. FIG. 5 also shows a plurality of fastener apertures and fasteners therein to secure the upper and lower portions of the reversible projected implement movement controller/base 150 together. FIG. 6 illustrates an enlarged side perspective view of the reversible projected implement movement controller/base 150 of the activity device 100 of FIG. 1

Figure 7:
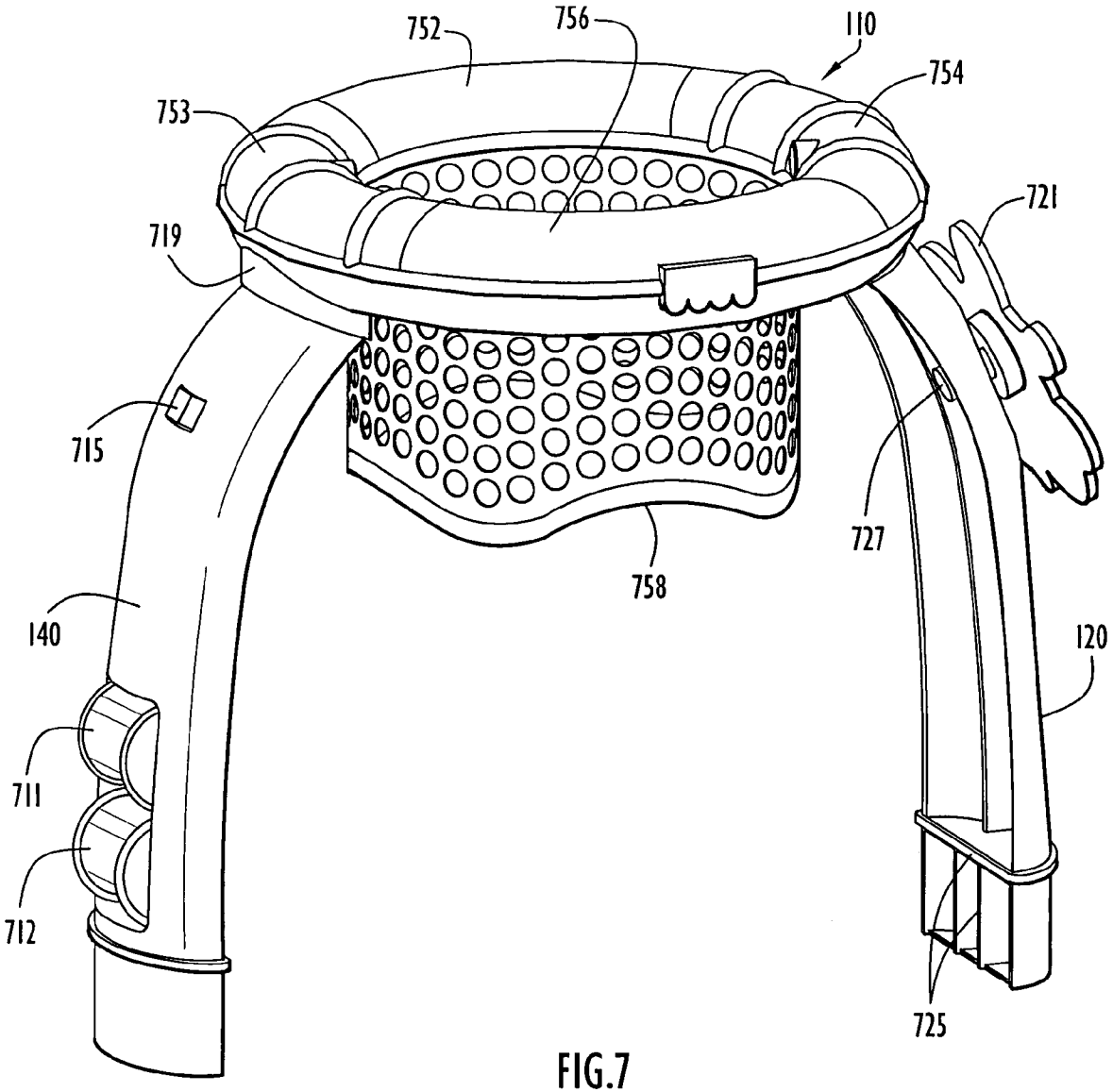
FIG. 7 illustrates an enlarged side perspective view of the target area and target support arms of the activity device of FIG. 1.

FIG. 7 illustrates an enlarged side perspective view of the target portion 110 and target support arms 120, 140 of the activity device 100 of FIG. 1. As discussed briefly above, the activity device 100 of the present invention has a hooped or ringed target portion 110 that is supported above the reversible base 150 by support arms 120 and 140. The upper portion of the hoop is composed of two opaque portions 753, 754 and two translucent portions 752, 756. The target portion 110 houses electronic components that produce light which shines from the translucent upper portions 752, 756 of the target portion 110. A fabric net 758 is suspended from the inside of the target portion 110 to create a basketball style activity.

Support arms 120 and 140 extend from a lower portion 719 of the target portion 110 and extend downward. Support arm 140 includes electronic components (e.g., wiring) associated with power, sound and light. Support arm 140 also houses the power/volume switch 715 on the outside surface of the arm 140 and contains apertures (best seen in FIG. 15) through which sound, generated by a speaker passes. The electronic features of the activity device 100 of the present invention will be explained in more detail below.

Support arm 140 also supports two mechanical activity rollers 711 and 712. The rollers provide additional entertainment value and are also intended to improve a child's manual dexterity. Both support arms 120 and 140 may include an external raised design that is molded into the arm. In the illustrated embodiment, the raised design is stylized as a serpentine vine with leaves. The lower end of support arms 120 and 140 may be mechanically and electronically connected to the reversible base 150. Details of the connection of the support arms 120 and 140 to the reversible base 150 will be discussed in more detail below.

Support arm 120 extends from an upper end that is attached to the lower portion 719 of the target portion 110 down to a lower end that also is connectable to the reversible base 150. The support arm 120 does not contain any electronic elements and is generally hollow. Stiffening ribs 725 extend along the length and width of the arms 120 and 140 to minimize the amount of material necessary while maintaining the structural rigidity of the arms 120 and 140. An animal-styled mechanical spinner 721 is supported on the outer side of support arm 120 to perform cartwheels when batted by a child. The spinner 721 is connected to and supported on a projection 727 that is rotatably secured in the support arm 120. Like support arm 140, the lower portion of support arm 120 is connectable to the reversible base 150, which connection will be described below in more detail.

Figure 8:
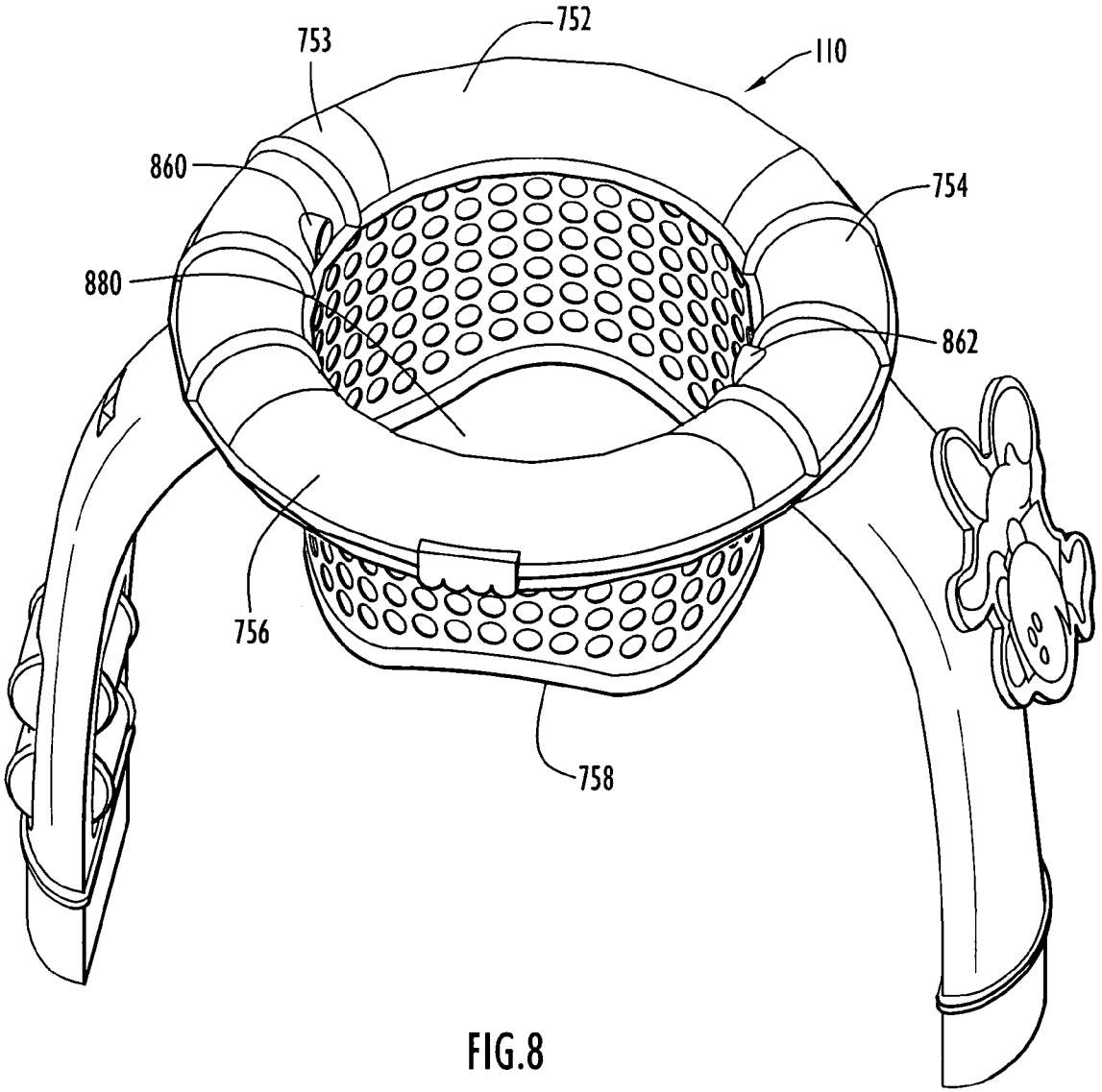
FIG. 8 illustrates an enlarged top perspective view of the target area and target support arms of the activity device of FIG. 1.
Figure 9:
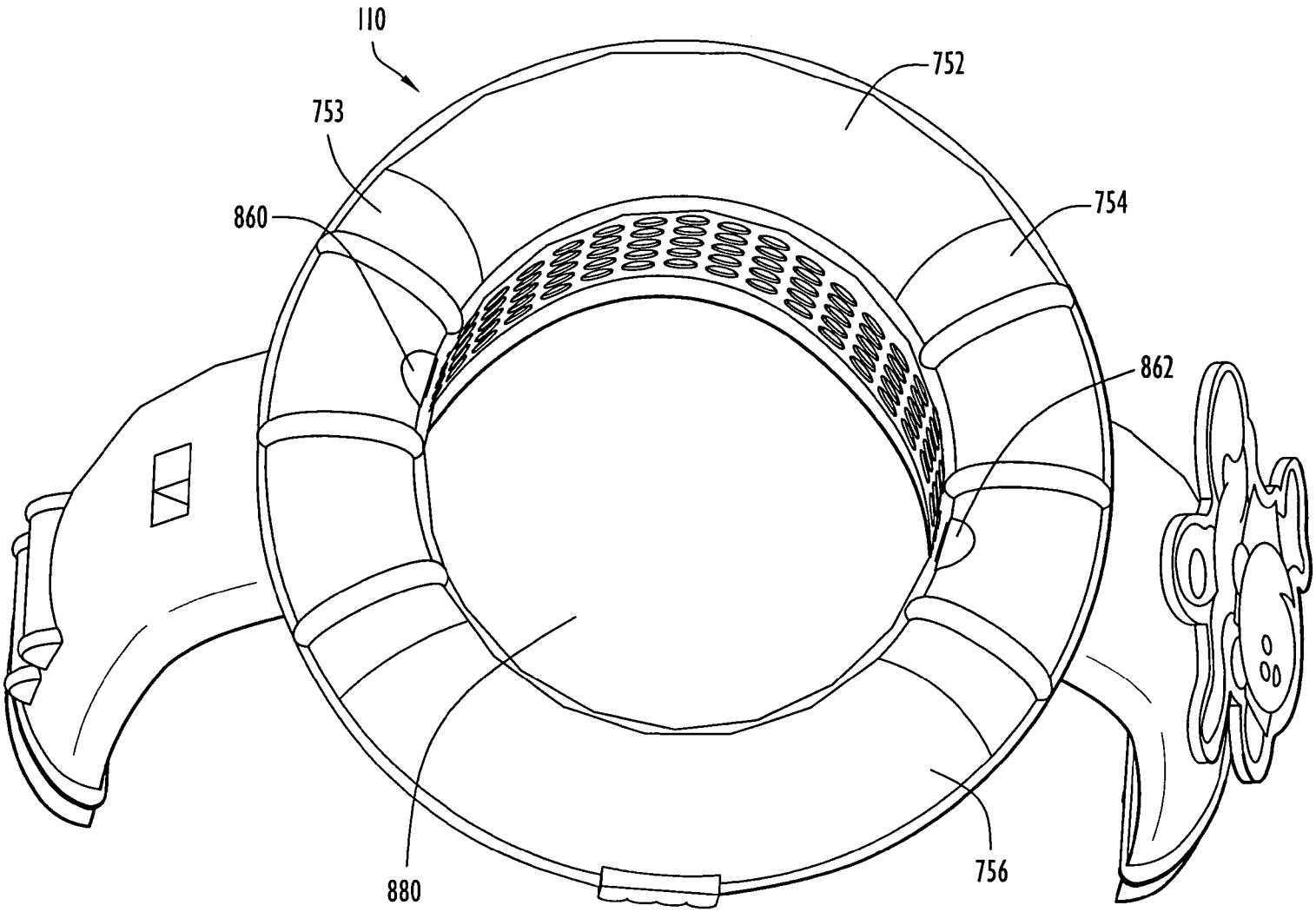
FIG. 9 illustrates a close-up enlarged top perspective view of the target area of the activity device of FIG. 1.

FIGS. 8 and 9 also illustrate enlarged images of the support arms 120 and 140 as well as the target portion 110. FIGS. 8 and 9 also show the sensor transmitter 860. The sensor receiver 862 is located on the opposite side of the target portion 110 from the sensor transmitter 360. In the illustrated embodiment, the sensor transmitter/receiver 860, 862 is an optical sensor. A beam of light is directed from the transmitter 860 across the opening 880 in the target portion 110 to the receiver 862. Obviously, the positions of the sensor's transmitter 860 and receiver 862 can be reversed. When a projectile/implement 130 (see FIG. 1) passes through the opening 880 in the target portion 110, it interrupts the beam of light passing from the transmitter 860 across the opening 880 in the target portion 110 to the receiver 862 which sends a signal to a sensory-output generating device. The sensory-output generating device then generates sensory output to reward the child for placing or tossing the projectile/implement 130 into the opening 880 in the target portion 110 . The operation of the electronic components of the activity device 100 of the present invention will be discussed in more detail below.

Figure 10:
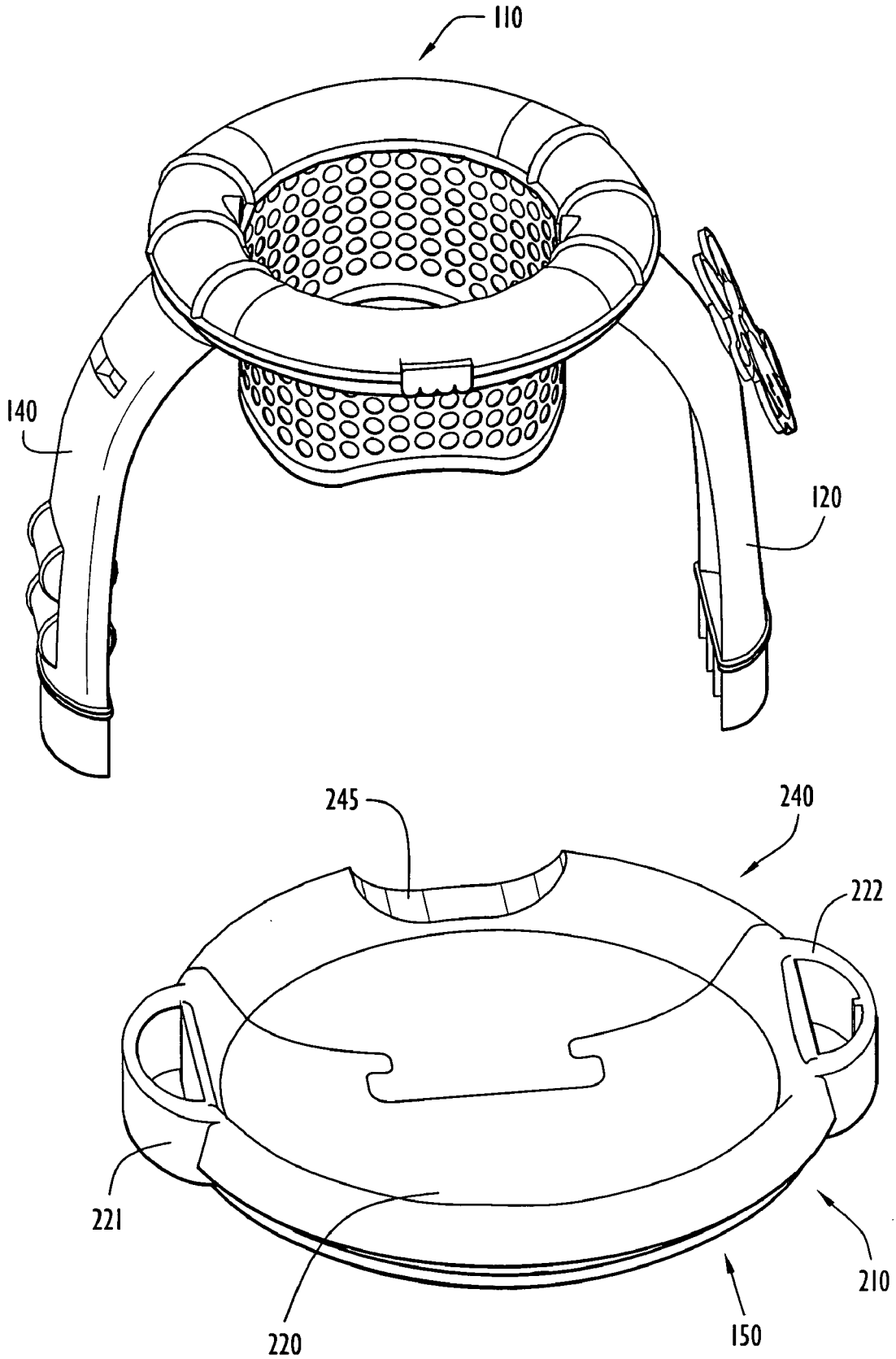
FIG. 10 illustrates an enlarged perspective view of the concave side of the reversible projected implement movement controller/base, the target area, and the target support arms of the activity device of FIG. 1.

FIG. 10 illustrates an enlarged perspective view of the concave side 220 of the reversible projected implement movement controller/base 150, the target portion 110, and the target support arms 120, 140 of the activity device 100 of FIG. 1. After assembly of the two portions 210 and 240 of the reversible projected implement movement controller/base 150, the basic assembly of the activity device 100 is complete. Disassembling the activity device 100 and reassembling the activity device 100 between the containment mode and the deflection mode requires only reversing the base 150 which does not require the use of any fasteners or tools. Thus, reconfiguration between the containment mode and the deflection mode amounts to not much more than a plug-in/plug-out type of exercise. FIG. 10 shows the assembled base 150 of the activity device 100 device ready to be assembled into either the containment mode or the deflection mode. Specifically, when the base 150 of the activity device 100 is assembled in the orientation shown in FIG. 10, the result is a completely assembled activity device 100 in the containment mode in which projectiles/implements 130 are collected in the concave side 220 of the base 150 after passing through the target portion 110.

Figure 11:
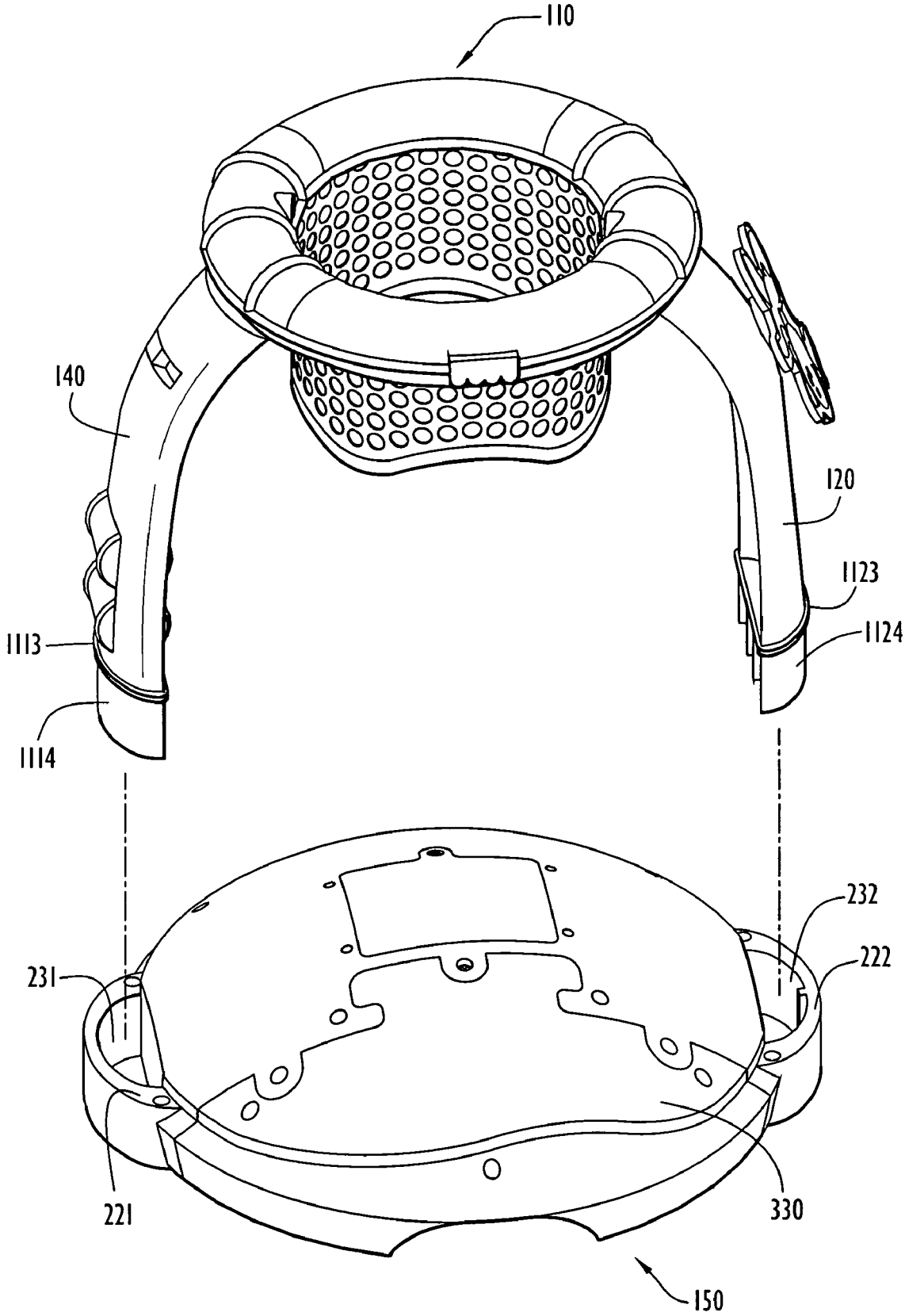
FIG. 11 illustrates manner of connection of the reversible projected implement movement controller/base and the target support arms of the activity device of FIG. 1 during assembly into the deflection mode.

FIG. 11 illustrates manner of connection of the reversible projected implement movement controller/base 150 and the target support arms 120, 140 of the activity device 100 of FIG. 1 during assembly into the deflection mode. Specifically, when the activity device 100 is assembled in the orientation shown in FIG. 11, the result is a fully assembled activity device 100 in the deflection mode. To assemble the activity device 100 in the deflection mode, the lower connection ends 1114, 1124 of the support arms 140, 120 are vertically aligned with their corresponding support arm reception slots 231 and 232 in the base 150. The connection ends 1114, 1124 are lowered and slid into and received by the support arm reception slots 231, 232. The connection ends 1114, 1124 slide into the support arm reception slots 231, 232 until they reach end stops 1113 and 1123.

Figure 12:
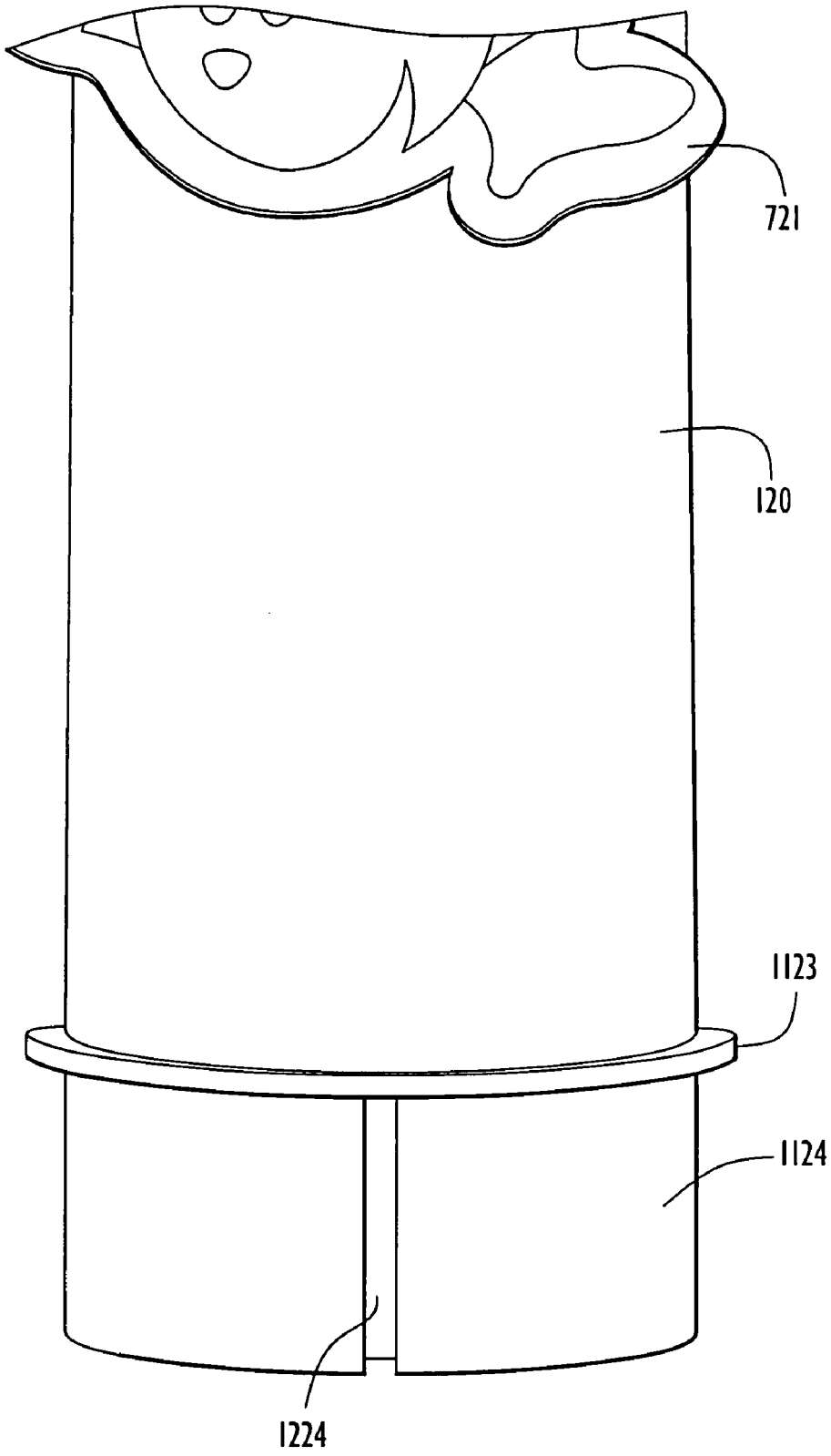
FIG. 12 illustrates an enlarged perspective view of the connection end of one of the target support arms of the activity device of FIG. 1.
Figure 13:
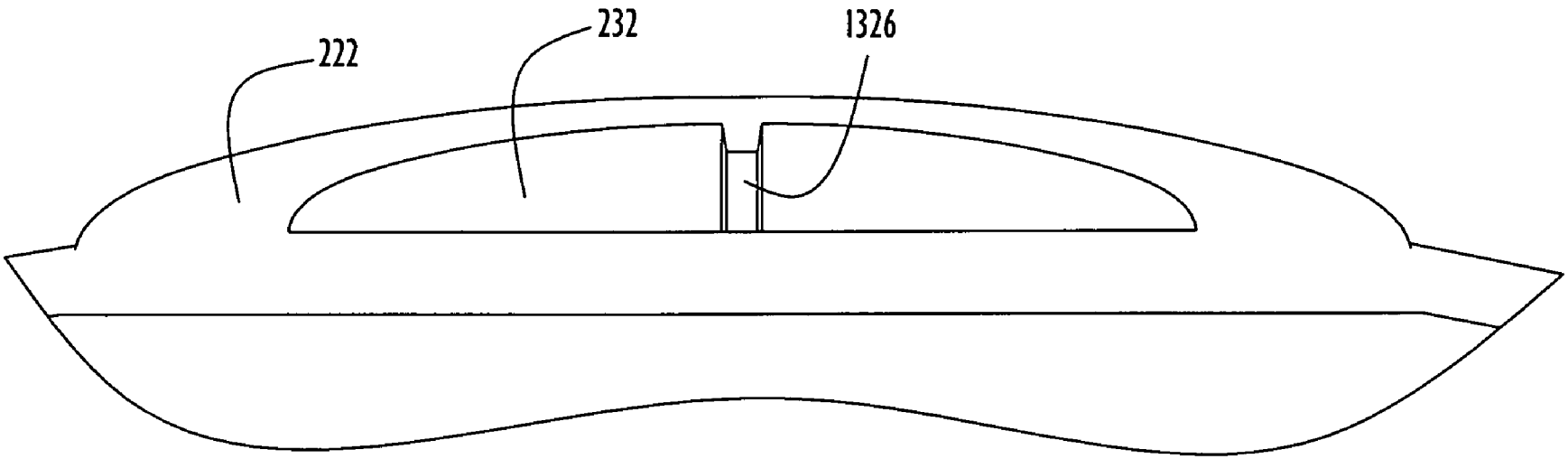
FIG. 13 illustrates an enlarged perspective view of one of the support arm reception slots of the reversible projected implement movement controller/base of the activity device of FIG. 1.
Figure 14:
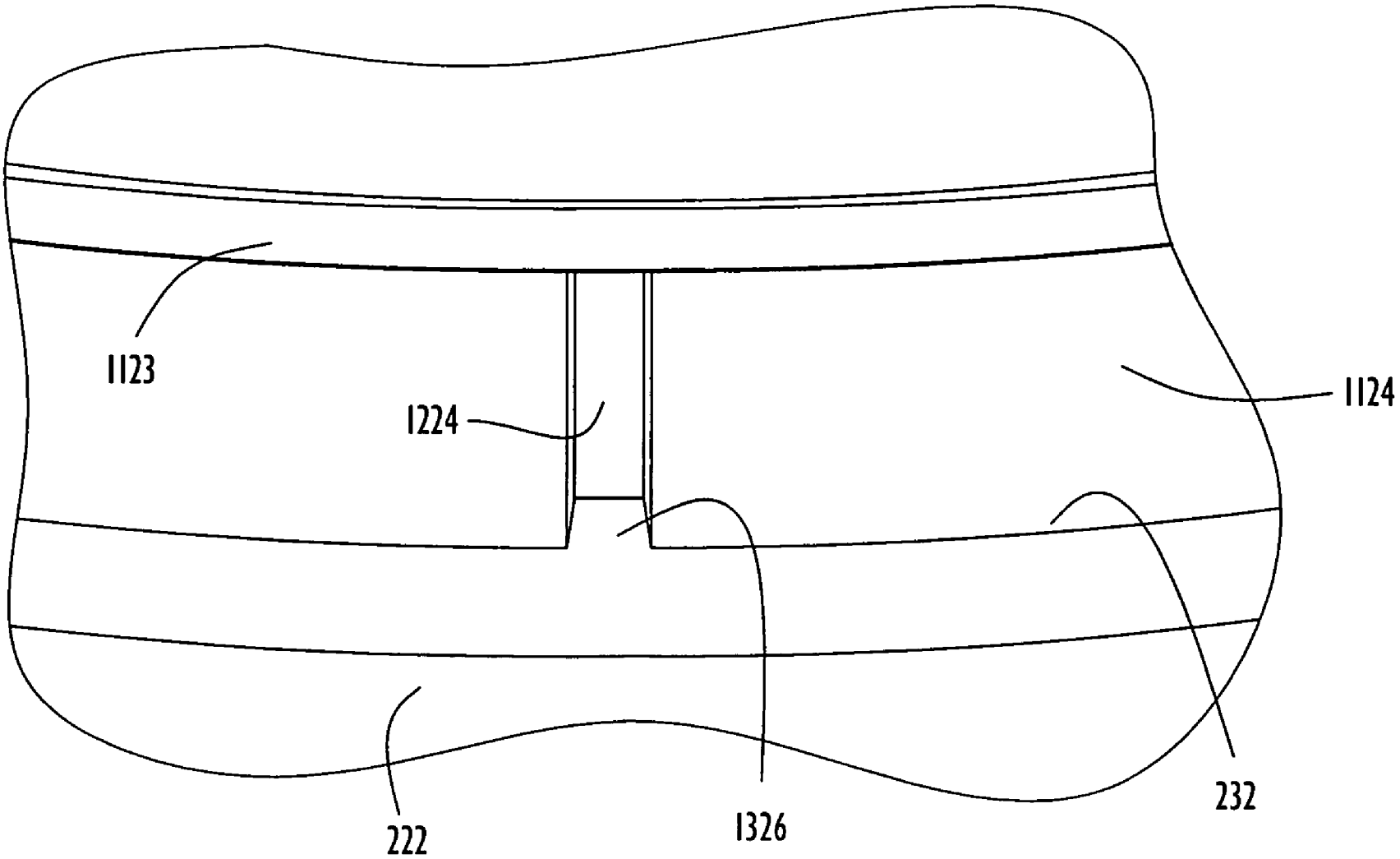
FIG. 14 illustrates an enlarged perspective view showing the connection end of the support arm received in the guided reception slot of the activity device of FIG. 1.

The connection between the support arms 120, 140 and the reversible base 150 will now be described in detail along with FIGS. 12-14. Because support arm 140 contains electronic components and support arm 120 does not, the support arms are not interchangeable within the support arm reception slots 231 and 232 in the base 150. In other words, connection ends 1114 must be received into reception slot 231 and connection end 1124 must be received into reception slot 232. To ensure that connection ends 1114 and 1124 are received only in the correct reception slots and to insure reception into the reception slots 231 and 232 with precise alignment, the connection end 1124 of the support arm 120 has guide members 1224.

Guide member 124 (shown in FIG. 12) is a groove in the outwardly facing surface of the connection end 1124 of support arm 120. As shown in FIG. 13, complementarily guide member 1326 is a longitudinal projection on the inside of looped member 222 projecting into reception slot 232 towards the center of the activity device 100. FIG. 14 shows connection end 1124 of support arm 120 partially inserted into reception slot 232 of the looped member 222. During insertion, guide member 1326 of the looped member 222 slides within grooved member 1224 of the connection end 1124 of support arm 120 to ensure proper alignment between the connection end 1124 and the reception slot 232. The connection end 1124 slides easily into the reception slot 232 until end stop 1123 prevents further insertion.

Figure 15:
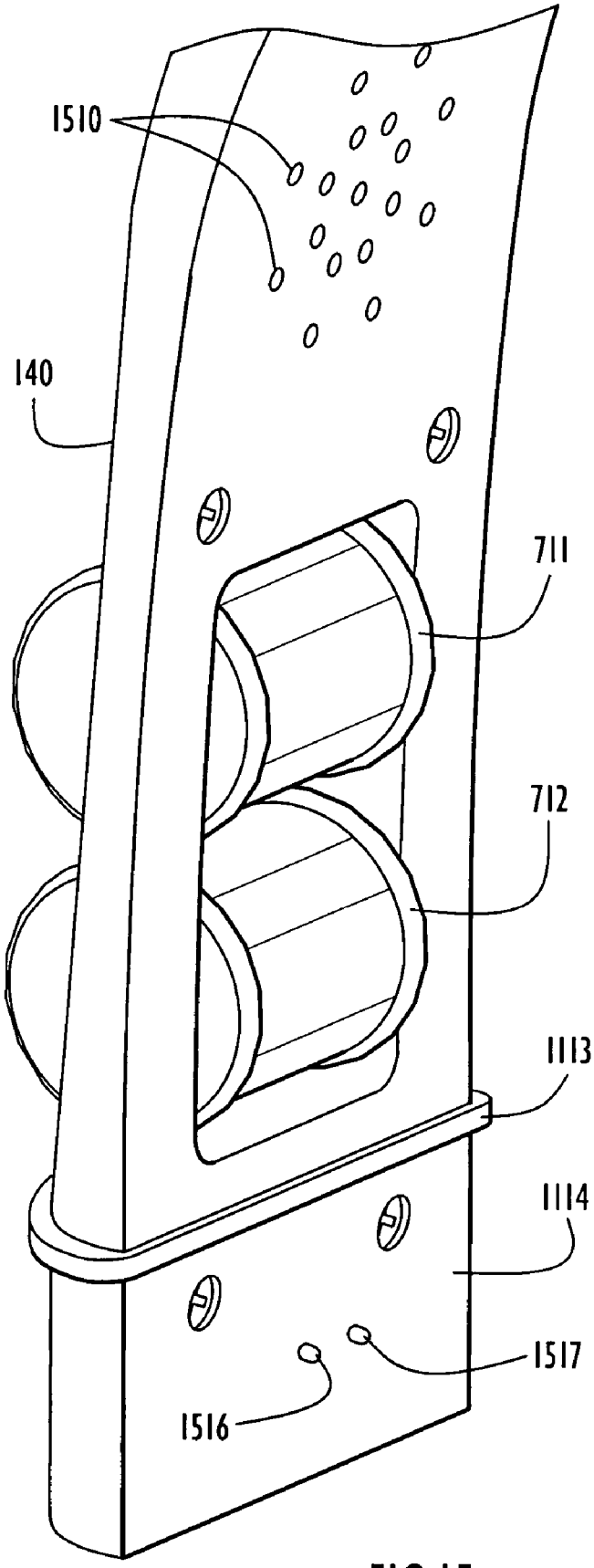
FIG. 15 illustrates an enlarged perspective view of the inner side of one of the support the activity device of FIG. 1.
Figure 16:
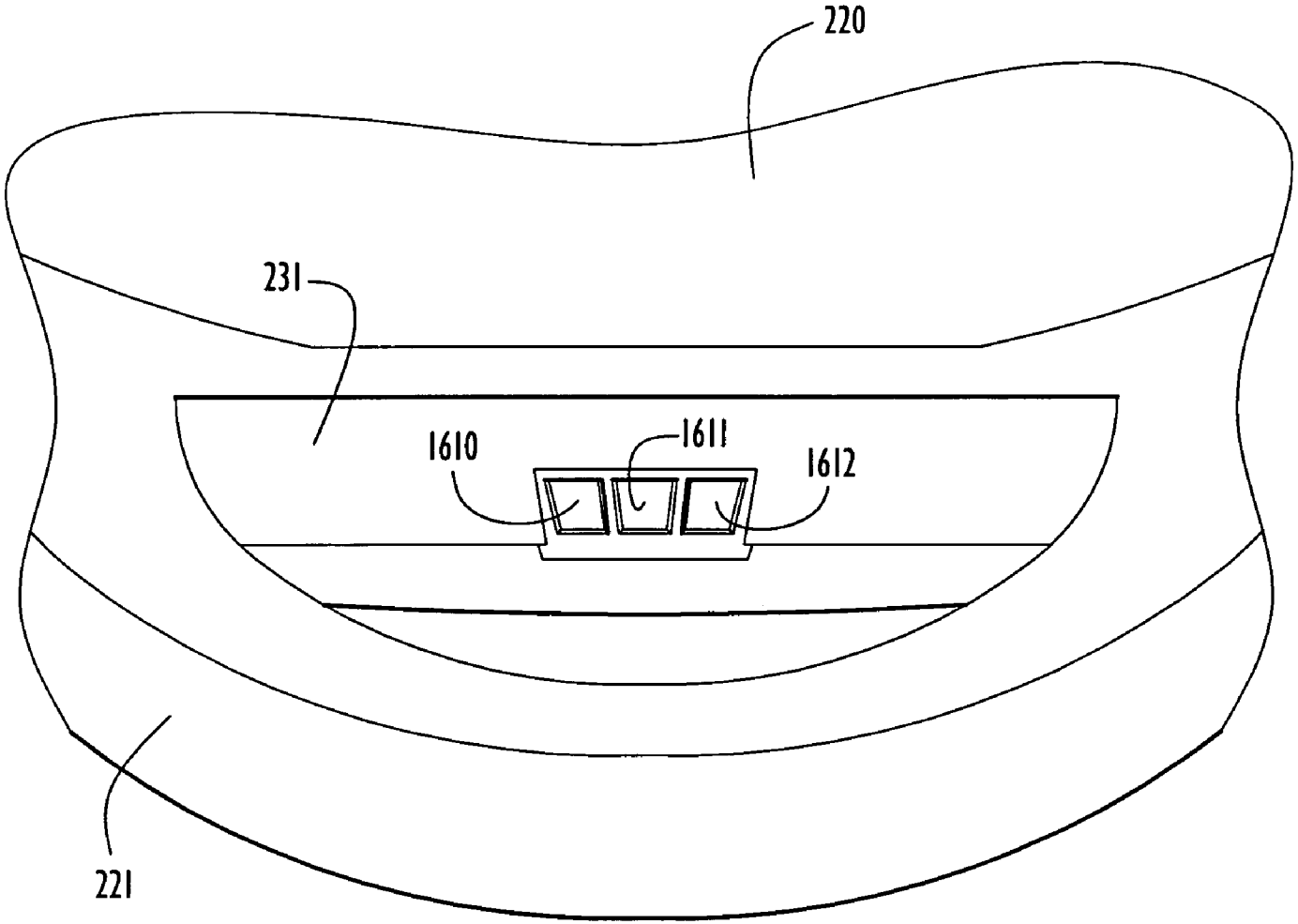
FIG. 16 illustrates an enlarged perspective view of the electrical contacts in another of the reception slots of the reversible projected implement movement controller/base of the activity device of FIG. 1.

FIGS. 15 and 16 illustrate how electrical contact is maintained between the portion of the electronic system within the reversible base 150 and the remainder of the electrical system within the support arm 140 and the target portion 110. FIG. 15 also illustrates a hole pattern 1510 on the inner surface of support arm 140. Hole pattern 1510 covers a sound producing speaker. The connection end 1114 of support arm 140 contains an inside electrical contact 1516 and an electrical projection contact 1517 both on the inside surface of the connection end 1114 of support arm 140. Contacts 1516 and 1517 conduct electrical current between the reversible base 150 and the target portion 110. Correspondingly and as illustrated in FIG. 16, the inside surface of the reception slot 231 has three reception electrical contacts 1610, 1611, and 1612 for receiving the inside electrical contact 1516 and the outside electrical contact 1517. The inside 1516 and outside 1617 electrical contacts are spring loaded so that they retract into the inner surface of the connector end 1114 when the connector end 1114 is being inserted into the reception slot 231. This retraction prevents the electrical contacts 1516, 1517 from becoming an obstacle to insertion of the connection end 1114 into 231.

The electronics assembly of the activity device 100 of the present invention can also identify the orientation of the reversible base 150 and thus the mode (containment or deflection) in which the activity device 100 is operating. Appropriate sensory-stimulating output can then be generated depending on the mode in which the activity device 100 is operating. Specifically, the activity device 100 can determine the mode because the inner electrical contact 1516 is always aligned with the central reception electrical contact 1611. However, the outside electrical contact 1517 is aligned with one of the outer reception electrical contacts 1610 in the containment mode and the other of the outside outer reception electrical contacts 1612 in the deflection mode when the base 150 is reversed. The orientation of the reversible base 150 may therefore be determined by detecting which of the outer reception electrical contacts 1610 or 1612 receives the outer electrical contact 1517. Again, these electrical contacts 1516, 1517, and 1610-1612 allow power and electrical signals to be passed between the power source and the electronics controller (housed in the base 150) to the speaker, lights, and receiver/transmitter (all of which are located in the support arms 120, 140 and the target portion 110) without the use of wires extending out of the base 150.

Figure 17:
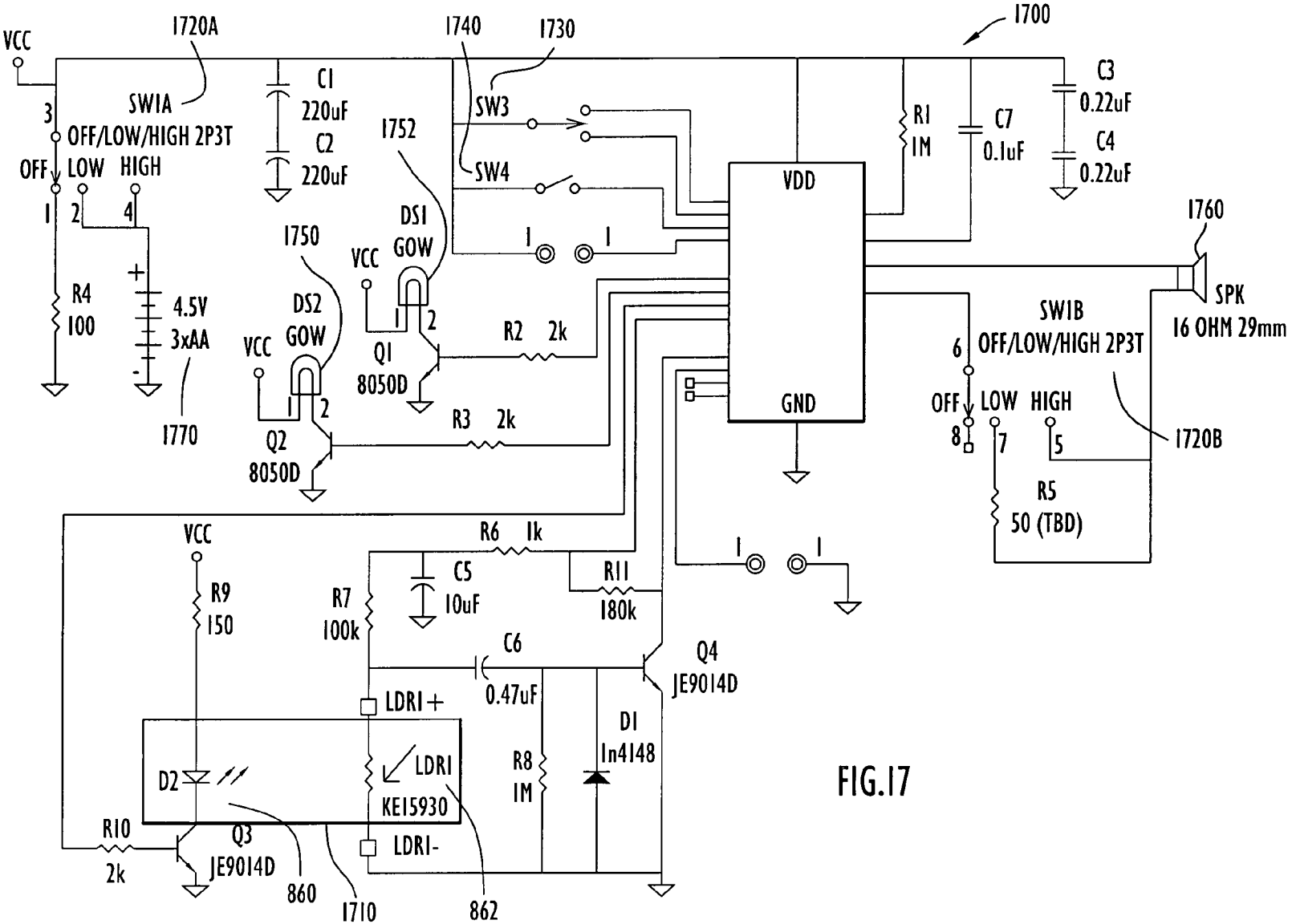
FIG. 17 illustrates an electronic schematic of the activity device of FIG. 1 in accordance with the present invention.

As discussed above, the activity device 100 of the present invention may include one or more electronic components. FIG. 17 illustrates an electronic schematic of the activity device 100 of FIG. 1 in accordance with the present invention. In the illustrated embodiment, the electronics assembly 1700 includes an optical sensor 1710. Specifically, the sensor of the electronics assembly 1700 includes an LED emitter (light emitting portion/transmitter) 860 and a corresponding photoconductive receiver (light receiving portion) 862 (e.g., where the light emitting portion and the light receiving portion makes up a "sensor pair"). The electronics assembly 1700 also includes two lights generators 1750, 1752. The light generators 1750, 1752 generally flash to the beat of the music. Light generators 1750, 1752 are housed beneath the two translucent portions 752, 756 of the target portion 110. The flashing lights 1750, 1752 act as a reward for various encouraged behavior. As discussed below, a number of events trigger a light display response in a number of different modes. The electronics assembly 1700 may further include a speaker 1760 coupled to both a microprocessor/electronics controller 1780 and the power source 1770.

The electronics assembly 1700 further includes three switches, each switch being associated with a particular feature of the activity device 100. Switch 1720A, 1720B is responsible for controlling power and volume options (switch 1720A and 1720B are simply illustrated as two poles of a single switch). Switch 1720A, 1720B may be used to control the connection of a power source 1770 to the electronics assembly 1700 (turning it on and off). The power source 1770 may include, for example, three "AAA" batteries. The schematic of FIG. 17 shows electrical contacts 1, 2 and 4 separate from contacts 8, 7 and 5, however, these contacts all belong to the same switch and are all controlled by power/volume (illustrated as switch 715 in FIG. 7). Therefore, when switch 1720A, 1720B is in position (1, 8), no battery power is available to the controller 1780. In position (2, 7), the battery power is available to the controller 1780 and a low sound is generated by the speaker 1760. Finally, in position (4, 5), power is available to the circuit and full sound is generated by the speaker 1760. When engaged in either of the second or third positions ("low", "high"), the switch 1720A, 1720B communicates with the microprocessor 1780, and switch-specific sensory output (sounds and/or lights) is generated.

A second internal switch 1730 may be included for additional functionality (such as a motion sensor housed within base 150). After the first switch 1720A, 1720B is activated, and power is available to the circuit, the controller unit 1780 illuminates lights 1750 and sounds before transferring to a sleep mode. The controller unit 1780 enters a sleep mode in which any further movement triggers lights and sounds. A third switch 1740 may be used to activate a "Try-Me" mode. The microprocessor controller unit 1780 has the "Try-Me" mode that can be activated when the product is still in the package on the retailer's shelf. In other words the shopper can activate the microprocessor unit 1780 to initiate a limited sample of the sounds and lights that would be generated in normal modes. When the packaging is removed the "Try-Me" mode may be disabled.

As noted above, each of the speaker 1760, the power source 1770, the light emitter 860 the light receiver 862, the switches 1720A-B, 1730, 1740, and the lights 750 are operatively coupled (connected) to the microprocessor unit 1780. The type of microprocessor is not limited, and includes microcontrollers, microprocessors, and other integrated circuits. Microprocessor unit 1780 recognizes and controls signals generated by and to the light emitter 860, the light receiver 862, the various switches 1720A-B, 1730, 1740, and the lights 750. In addition, microprocessor unit 1780 generates and controls operational output. The microprocessor unit 1780 continually monitors the electronic status of the light emitter 860, the light receiver 862 and the switches 1720A-B, 1730, and 1740, generating and altering the sensory output (e.g., sounds and/or lights) accordingly.

The operation of the activity device 100 will now be described. In operation, when the first switch 715 (internally, switch 715 is schematically illustrated as switch 1720A-B) is engaged, power is sent from the power source 1770 to the microprocessor unit 1780. Once powered and active, the microprocessor unit 1780 of the activity device 100 is in the start-up mode. In the start up mode, the microprocessor unit 1780 activates lights from the light sources 1750 and sounds from the speaker 1760 for a predetermined period of time. The microprocessor unit 1780 then changes to beam break mode. In beam break mode, the emitter 860 and the receiver 862 of the sensor 1710 in the target portion 110 is activated. If a ball/implement 130 passing through the target portion 110 breaks the beam, the microprocessor unit 1780 activates sounds through speaker 1760 and lights 1750 blink to the music. If the beam is not broken for a predetermined period of time (e.g., one minute), the microprocessor unit 1780 goes into "sleep" mode. In sleep mode, the beam break feature is turned off and the internal motion sensor 1730 feature (if present) may be activated. Whenever the activity device 100 is disturbed to activate motion sensor 1730, the microprocessor unit 1780 goes back to the start-up mode, generates sounds and flashing coordinated lights for a period of time, turns the beam break feature on and waits for the beam sensor 1710 to be broken by a ball/implement 130.

Figure 18:
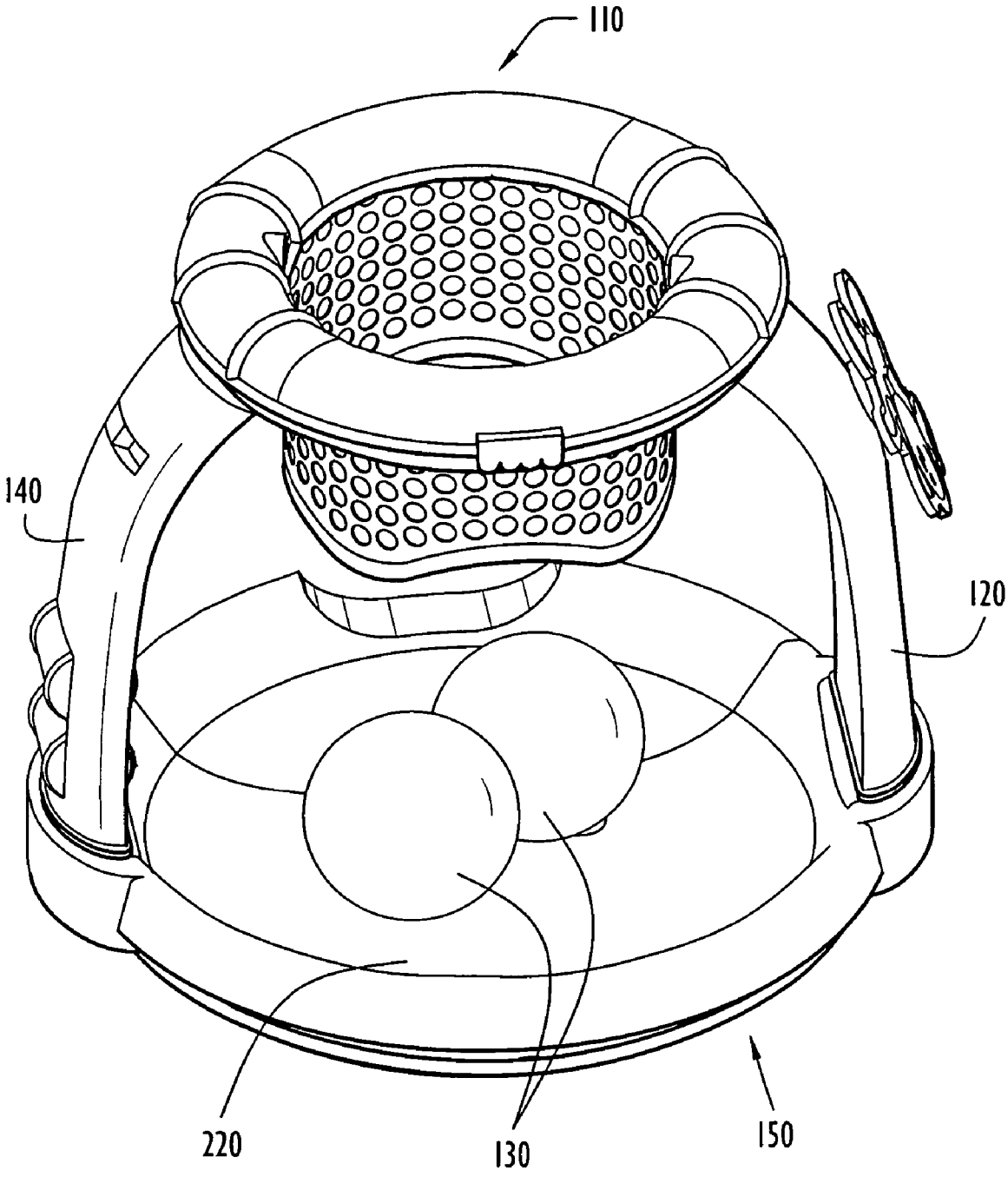
FIG. 18 illustrates a perspective view of the activity device of the present invention showing the reversible projected implement movement controller/base holding two projectiles while configured in the containment mode.

FIGS. 18-21 show the fully assembled activity device 100 in its various modes. FIG. 18 shows the activity device 100 in its containment mode with two balls/implements 130 that have passed through the target portion 110 and been contained in the concave surface 220 reversible base 150. As a child puts the balls/implements 130 through the target portion 110, the sensor beam is broken to activate sounds and lights before the balls/implements 130 are contained in the concave surface 220 reversible base 150. In this mode, the activity device 100 also rocks back and forth on the convex outer surface 330 of the reversible base 150.

Figure 19:
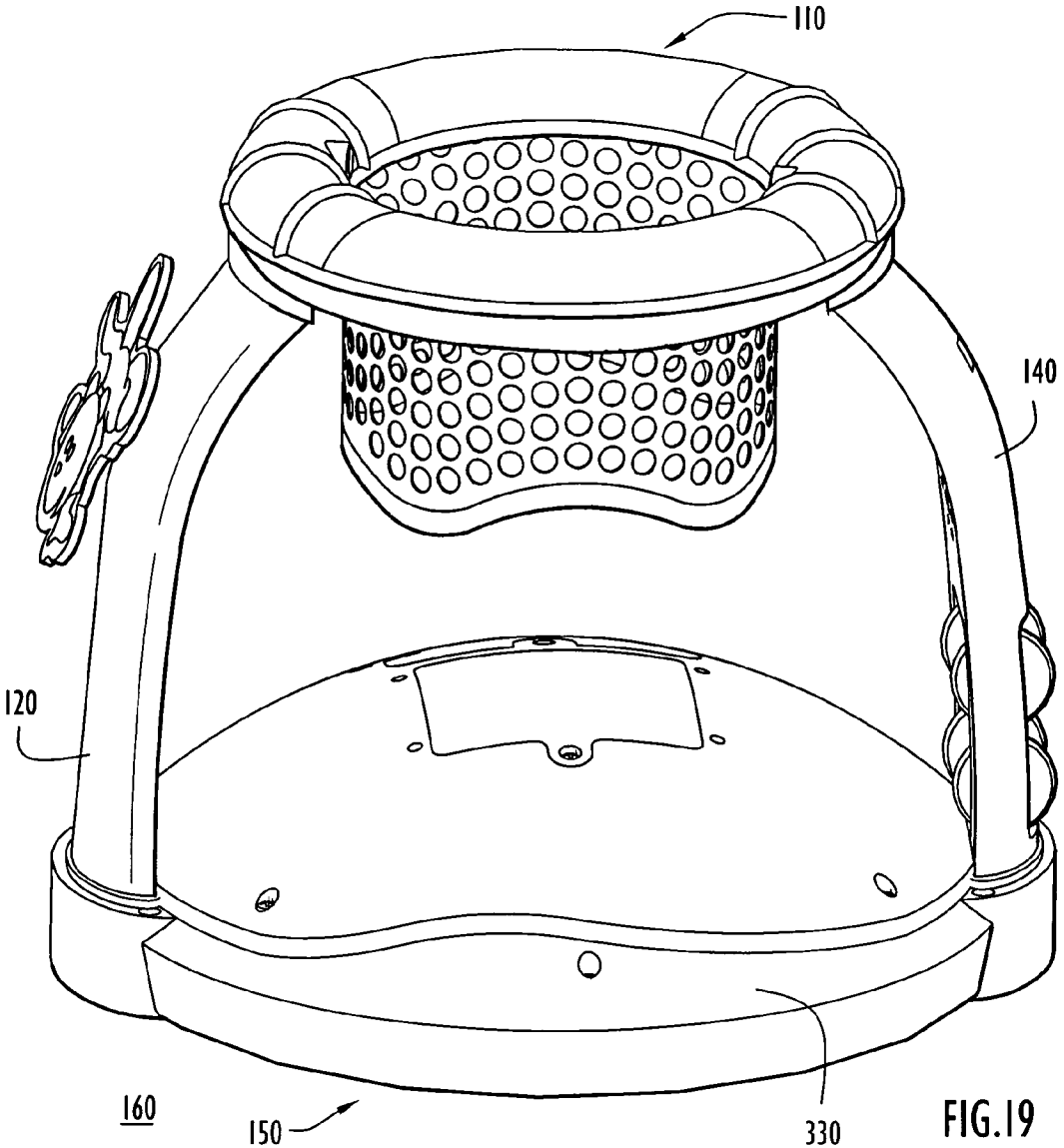
FIG. 19 illustrates an enlarged side perspective view of the activity device of FIG. 1 showing the reversible projected implement movement controller/base configured in the deflection mode.
Figure 20:
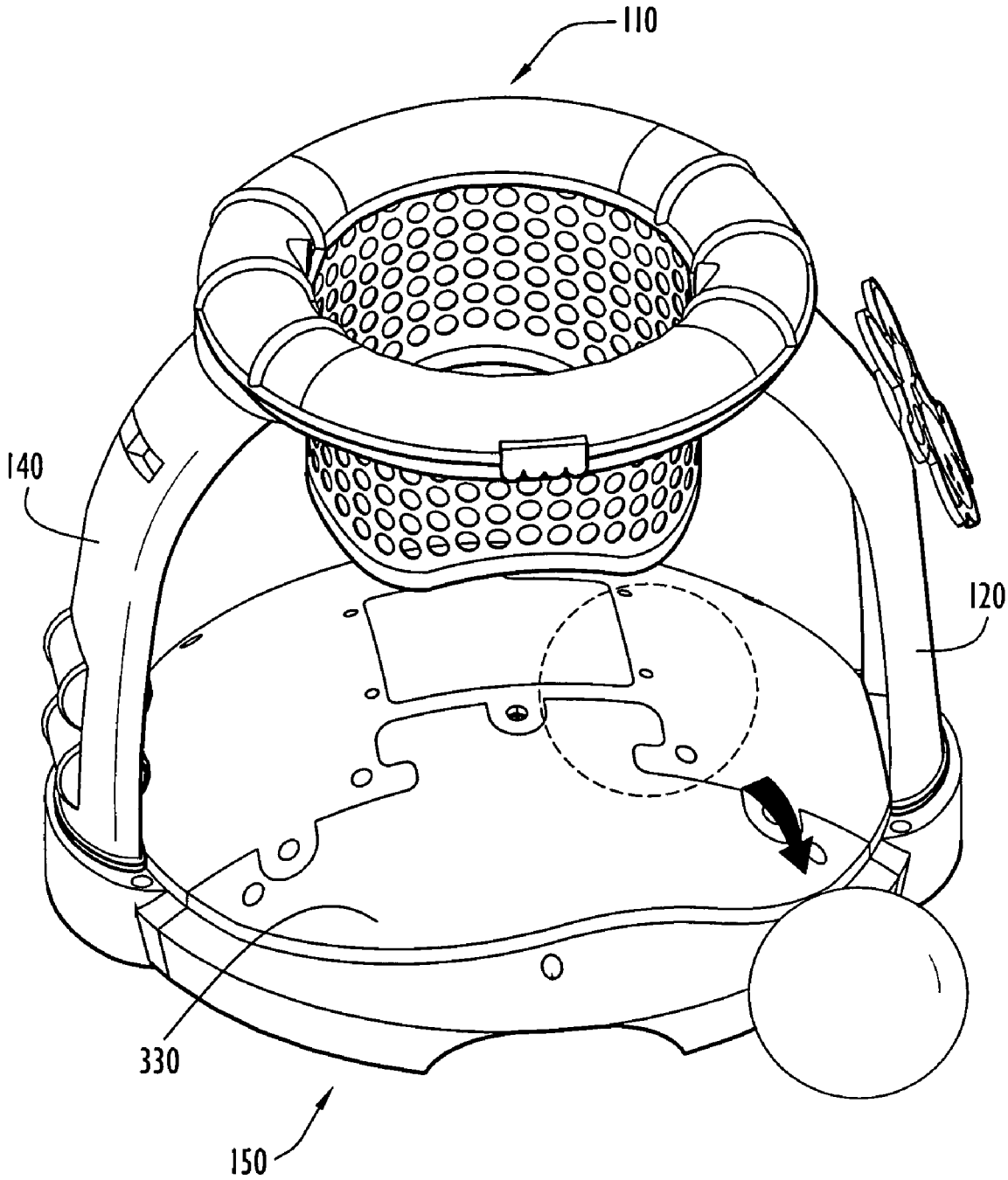
FIG. 20 illustrates an enlarged side perspective view of the activity device of FIG. 19 configured in the deflection mode and showing a projectile being deflected away from the activity device.

FIGS. 19-20 show the activity device 100 in the fully assembled deflection mode. In this deflection mode the convex surface 330 of the reversible base 150 faces the target portion 110. The portion of the reversible base 150 contacting the supporting surface 160 is stable and thus, the activity device does not rock in the deflection mode. When balls/implements 130 pass through the target portion 110 and break the sensor beam, the microprocessor unit 1780 generates lights and sounds. The balls/implements 130 then drop onto the convex surface 330 of the reversible base 150 and are deflected away from the activity device 100. The child can then chase and retrieve the balls/implements 130 before placing them in the target portion 110 again. FIG. 20 shows a ball/implement 130 in multiple positions as the ball contacts the convex surface 330 of the reversible base 150 and is directed away from the activity device 100.

The electronics assembly 1700 in accordance with the present invention may include any combination of sensors, switches, lights, speakers, animated members, motors, and sensory output generating devices. The microprocessor unit 1780 may produce any combination of audio and visual effects including, but not limited to, animation, lights, and sound (music, speech, and sound effects). The output pattern is not limited to that which is discussed herein and includes any pattern of music, lights, and/or sound effects. The electronics assembly 1700 may also include additional switches or sensors to provide additional sensory output activation without departing from the scope of the present invention.

Thus, it is intended that the present invention cover the modifications and variations of this invention that come within the scope of the appended claims and their equivalents. For example, it is to be understood that terms such as "left", "right" "top", "bottom", "front", "rear", "side", "height", "length", "width", "upper", "lower", "interior", "exterior", "inner", "outer" and the like as may be used herein, merely describe points of reference and do not limit the present invention to any particular orientation or configuration.

We claim:

1. A activity entertainment device comprising:

a projectile;

a target having a target area; and a convertible projectile movement controller, wherein said projectile movement controller is convertible between a first mode wherein after said projectile passes through said target area, said projectile movement controller directs said projectile away from said activity entertainment device and a second mode wherein after said projectile passes through said target area, the projectile is contained within said projectile movement controller, said projectile movement controller being bowl shaped and having a convex side and an opposed concave side and wherein said concave side of said projectile movement controller faces said target area in said second mode and said convex side of said projectile movement controller faces said target area in said first mode.

2. The activity entertainment device of claim 1, wherein said convertible projectile movement controller is a base disposed below said target area.

3. The activity entertainment device of claim 1, wherein said target area is an opening in a ring through which said projectile is dropped or tossed.

4. The activity entertainment device of claim 1, wherein said target includes a sensor for detecting the presence of said projectile passing therethrough.

5. The activity entertainment device of claim 3, wherein said ring includes a sensor for detecting the presence of said projectile as said projectile passes through said ring.

6. The activity entertainment device of claim 4, wherein said sensor is an optical sensor.

7. The activity entertainment device of claim 4, further comprising a sensory output generator wherein when said sensor detects the presence of said projectile, said sensor communicates with said sensory output generator to generate sensory-stimulating output.

8. The activity entertainment device of claim 2, wherein said base has at least a first side and a second side and said base is removable from said target and reversible so that in said first mode said first side faces said target area and in said second mode said second side faces said target area.

9. The activity entertainment device of claim 8, wherein said target has a sensor for detecting the presence of said projectile, wherein said base contains a power source and wherein said power source powers said sensor.

10. An activity entertainment device for receiving a projectile comprising:

a target having a target area and including a sensor for detecting the presence of said projectile within said target area;

a base, wherein said base has a deflection side and an opposed containment side, said base being reversible between a first mode wherein after said projectile passes through said target area, said deflection side of said base directs said projectile away from said activity entertainment device and a second mode wherein after said projectile passes through said target area, said projectile is contained within said containment side of said base; and a sensory output generator configured wherein when said sensor detects the presence of said projectile, said sensor communicates with said sensory output generator to generate sensory-stimulating output.

11. The activity entertainment device of claim 10, wherein said target is a ring through which said projectile passes.

12. The activity entertainment device of claim 10, wherein said base is bowl shaped and said containment side of said base is concave and said deflection side of said base is convex.

13. The activity entertainment device of claim 12, wherein said containment side of said base faces said target area in said second mode and said deflection side of said base faces said target area in said first mode.

14. The activity entertainment device of claim 13, wherein said target includes a sensor for detecting the presence of said projectile within said target area and comprising a sensory output generator wherein when said sensor detects the presence of said projectile, said sensor communicates with said sensory output generator to generate sensory-stimulating output.

15. The activity entertainment device of claim 10, wherein said base contains a power source and wherein said power source powers said sensor.

16. A method of reconfiguring the activity entertainment device of claim 10, the method comprising the steps of:

providing a projectile; and reconfiguring a said base between said first mode wherein after said projectile passes through said target area, said base directs said projectile away from said activity entertainment device, and said second mode wherein after said projectile passes through said target area, said projectile is contained within said containment side of said base.

17. The method of claim 16, wherein said deflection side of said base is convex and said containment side of said base is concave.

18. The method of claim 17, wherein the step of reconfiguring further comprises separating said base from said target and reversing said from said convex side to said concave side or from said concave side to said convex side before reattaching said base to said target.

19. The method of claim 18, further comprising the step of directing said projectile through said target area and retrieving said projectile from said base.

20. The method of claim 18, further comprising the step of directing said projectile through said target area and retrieving said projectile after said deflection side directs said projectile away from said base.

* * * * *